US011598124B2

(12) United States Patent
Kane

(10) Patent No.: US 11,598,124 B2
(45) Date of Patent: Mar. 7, 2023

(54) MULTIPOINT LOCKING DOOR HARDWARE

(71) Applicant: Roto Frank of America, Chester, CT (US)

(72) Inventor: Paul H. Kane, Scotland (GB)

(73) Assignee: Roto Frank of America, Inc., Chester, CT (US)

( * ) Notice: Subject to any disclaimer, the term of this patent is extended or adjusted under 35 U.S.C. 154(b) by 105 days.

(21) Appl. No.: 17/161,095

(22) Filed: Jan. 28, 2021

(65) Prior Publication Data

US 2021/0222463 A1 Jul. 22, 2021

Related U.S. Application Data

(63) Continuation of application No. 15/104,725, filed as application No. PCT/IB2014/067177 on Dec. 19, 2014, now Pat. No. 10,907,379.

(Continued)

(51) Int. Cl.

*E05B 13/00* (2006.01)
*E05B 15/02* (2006.01)

(Continued)

(52) U.S. Cl.

CPC ..... *E05B 59/00* (2013.01); *E05B 13/002* (2013.01); *E05B 15/0205* (2013.01); *E05B 63/18* (2013.01); *E05C 7/06* (2013.01); *E05C 9/041* (2013.01); *E05C 9/043* (2013.01); *E05C 9/047* (2013.01)

(58) Field of Classification Search

CPC .... E05B 59/00; E05B 13/002; E05B 15/0205; E05B 63/18; E05C 7/06; E05C 9/041; E05C 9/043; E05C 9/047

See application file for complete search history.

(56) References Cited

U.S. PATENT DOCUMENTS 1,075,914 A * 10/1913 Hoes ..... E05C 9/06 70/108
5,498,038 A 3/1996 Simon et al.

(Continued)

OTHER PUBLICATIONS

EPO as ISA, PCT/IB2014/067177 filed Dec. 19, 2014, "International Search Report and Written Opinion" dated Mar. 31, 2015, 10 pages.

*Primary Examiner* — Kristina R Fulton
*Assistant Examiner* — Thomas L Neubauer
(74) *Attorney, Agent, or Firm* — David Millers

(57) ABSTRACT

A lock system includes an active panel center gearbox. The active panel center gearbox includes a deadbolt, a deadbolt drive to extend or retract the deadbolt, an upper drive assembly, a lower drive assembly, a latch bolt, a handle assembly to retract the latch bolt and to extend or retract the lower and the upper driver assemblies, a reverse action rocker coupling the lower and the upper drive assemblies so they move in different directions, a mishandling bolt, and a mishandling plate. When the mishandling bolt extends, it lowers the mishandling plate. When the mishandling plate lowers, it engages the deadbolt to prevent the deadbolt from extending, it engages the handle assembly to prevent the lower drive assembly from extending, and it engages the reverse action rocker to prevent the upper drive assembly from extending.

13 Claims, 35 Drawing Sheets

Related U.S. Application Data

(60) Provisional application No. 61/917,945, filed on Dec. 19, 2013.

(51) Int. Cl.

| | |
|---|---|
| ***E05B 59/00*** | (2006.01) |
| ***E05B 63/18*** | (2006.01) |
| ***E05C 9/04*** | (2006.01) |
| ***E05C 7/06*** | (2006.01) |

(56) References Cited

U.S. PATENT DOCUMENTS

| | | | | |
|---|---|---|---|---|
| 6,209,931 | B1 | 4/2001 | Stoutenborough et al. | |
| 7,677,067 | B2 * | 3/2010 | Riznik | E05C 9/1841 70/472 |
| 8,550,506 | B2 | 10/2013 | Nakanishi et al. | |
| 8,657,345 | B1 | 2/2014 | Shih | |
| 9,428,937 | B2 | 8/2016 | Tagtow et al. | |
| 2004/0194519 | A1 | 10/2004 | Chen | |
| 2005/0166647 | A1 | 8/2005 | Walls et al. | |
| 2008/0184749 | A1 | 8/2008 | Alber et al. | |

* cited by examiner

MULTIPOINT LOCKING DOOR HARDWARE

CROSS REFERENCE TO RELATED APPLICATION

This application is a continuation and claims benefit of the earlier filing date of U.S. patent application Ser. No. 15/104,725, filed Jun. 15, 2016, which is the U.S. National Stage of PCT App. No. PCT/IB/2014067117, filed Dec. 19, 2014 and which claimed benefit of U.S. Provisional Application No. 61/917,945, filed Dec. 19, 2013, all of which are incorporated herein by reference.

DESCRIPTION OF RELATED ART

Entry door and patio door systems for hinged doors include components such as visible interior and exterior handles, lock cylinders and knobs, hinges and the mostly concealed locking mechanisms and strike plates. When a multipoint locking system is used, a lever handle is added to activate the system.

BRIEF DESCRIPTION OF THE DRAWINGS

In the drawings:

FIGS. 2-1 and 2-2 are exploded views of an active panel center gearbox of FIG. 1 from different angles in examples of the present disclosure;

FIG. 3 shows certain assemblies from the active panel center gearbox of FIG. 1 in examples of the present disclosure.

FIGS. 4 and 5 are front and back perspective views of the active panel center gearbox of FIG. 1 at an initial "open" state in examples of the present disclosure;

FIGS. 22, 23-1, and 23-2 are perspective views of the passive panel center gearbox of FIG. 19 at an initial "primed" state in examples of the present disclosure;

Use of the same reference numbers in different figures indicates similar or identical elements.

DETAILED DESCRIPTION OF THE INVENTION

Figure 1:
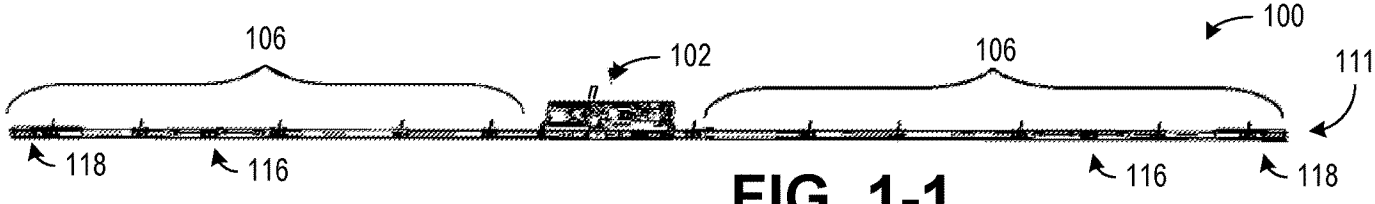
FIGS. 1-1, 1-2, 1-3, and 1-4, each generically referred to herein as FIG. 1, show variations of an active panel lock system in examples of the present disclosure.

As used herein, the term "includes" means includes but not limited to, the term "including" means including but not limited to. The terms "a" and "an" are intended to denote at least one of a particular element. The term "based on" means based at least in part on. The term "or" is used to refer to a nonexclusive such that "A or B" includes "A but not B," "B but not A," and "A and B" unless otherwise indicated. The term "assembly" is used to refer to elements that may be integrated as a single element or a less number of elements.

Active Panel Lock System

FIGS. 1-1, 1-2, 1-3, and 1-4 show variations of an active panel lock system 100 for doors in examples of the present disclosure. Active panel lock system 100 may be a suite of components that can be selectively assembled to provide multipoint locking active panels (primary operating door panels) having various backsets, heights, and secondary locks. Each variation of active panel lock system 100 includes an active panel center gearbox 102, a lower extension 104, an upper extension 106, and an optional mid extension 108. Active panel center gearbox 102 may also be referred to as a lockbox, gear, or lock gear. Active panel center gearbox 102 may come in a variety of backsets. Mid extension may be added between active panel center gearbox 102 and upper extension 106 to accommodate for greater door heights. Lower extension 104 and upper extension 106 may be equipped with a combination of secondary locks, such as tongues, hooks, and shoot bolts, that are activated by active panel center gearbox 102.

In FIGS. 1-1, 1-2, 1-3, and 1-4, four variations 111, 112, 113, and 114 are respectively illustrated to demonstrate some possible component combinations of active panel lock system 100. Variation 111 includes an active panel center gearbox 102, a lower extension 104 equipped with a tongue lock mechanism 116 and a shoot bolt mechanism 118, and an upper extension 106 equipped with a tongue lock mechanism 116 and a shoot bolt mechanism 118. Variation 112 includes an active panel center gearbox 102, a lower extension 104 equipped with a hook lock mechanism 120 and a shoot bolt mechanism 118, and an upper extension 106 equipped with a hook lock mechanism 120 and a shoot bolt mechanism 118. Variation 113 includes an active panel center gearbox 102, a lower extension 104 equipped with a shoot bolt mechanism 118, and an upper extension 106 equipped with a shoot bolt mechanism 118. Variation 114 includes an active panel center gearbox 102, a lower extension 104 equipped with a shoot bolt mechanism 118, and an upper extension 106 equipped with a shoot bolt mechanism 118, and a mid extension 108 between active panel center gearbox 102 and upper extension 106.

Figures 1, 2:
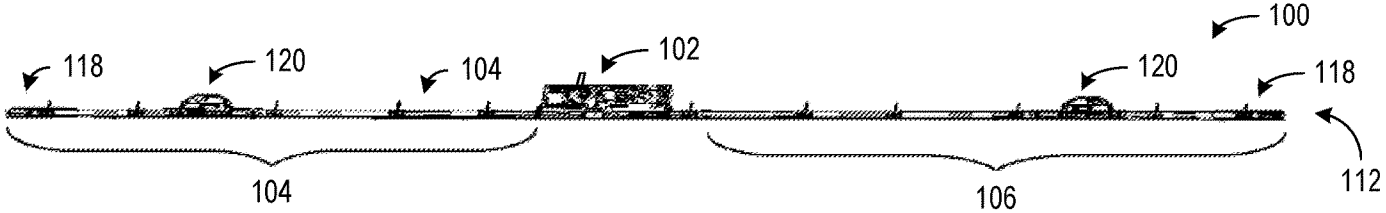
Figures 1, 2, 3:
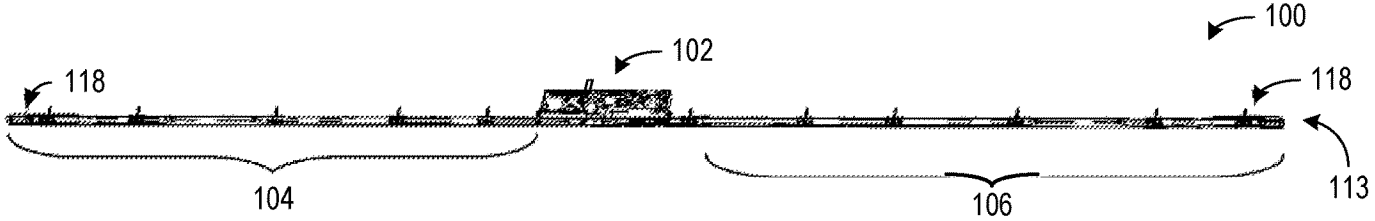
Figures 1, 2, 3, 4:
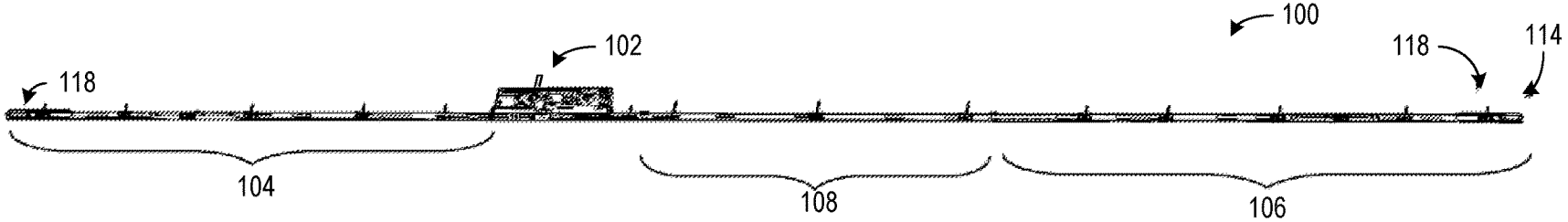
Figures 1, 2:
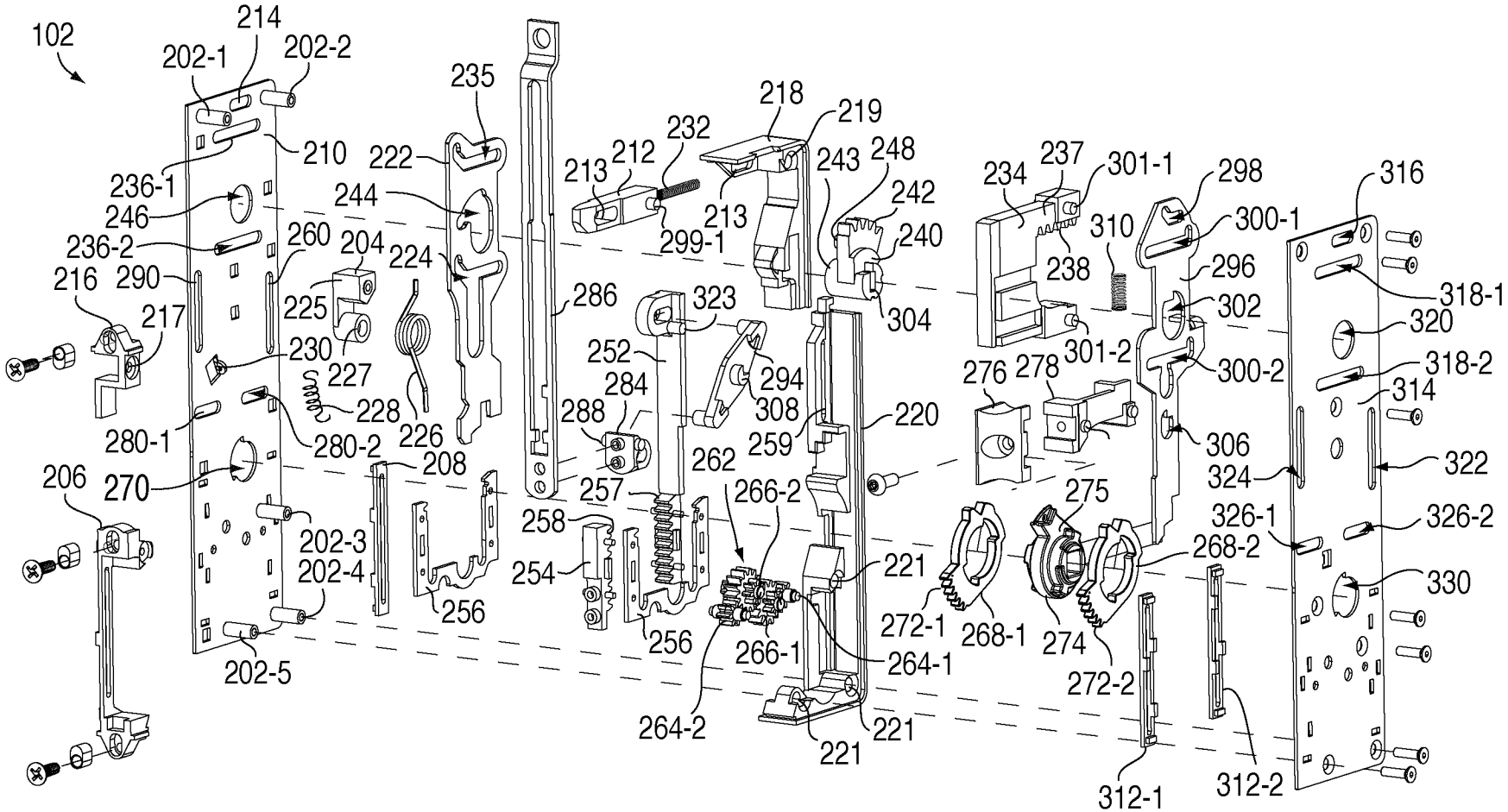
Figure 2:
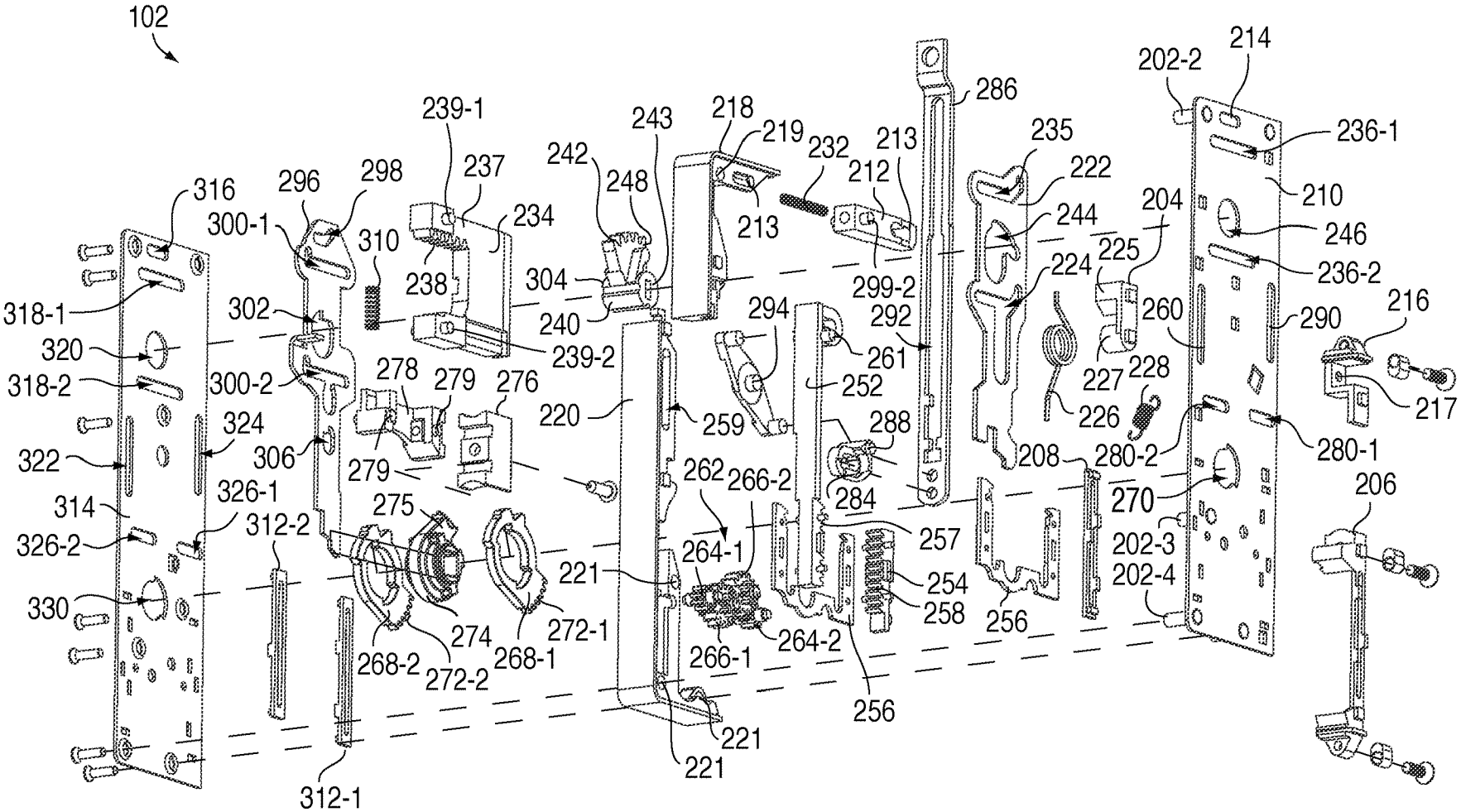
Figure 3:
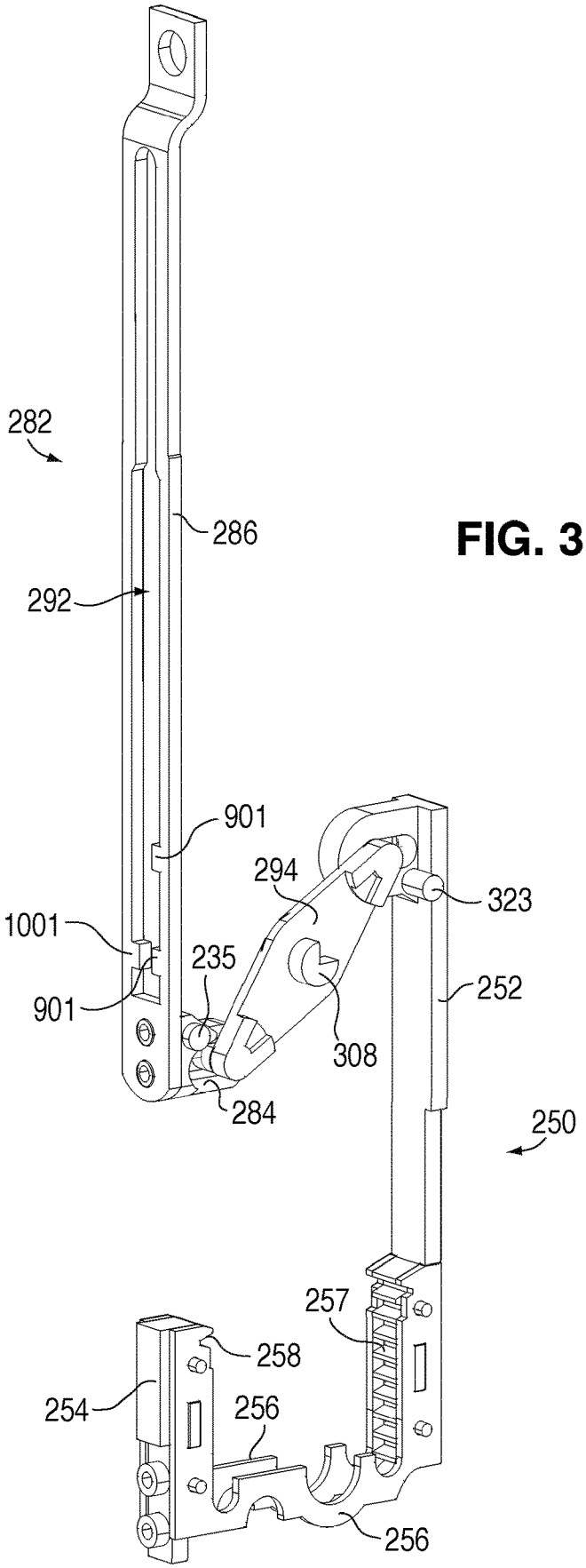
Figure 4:
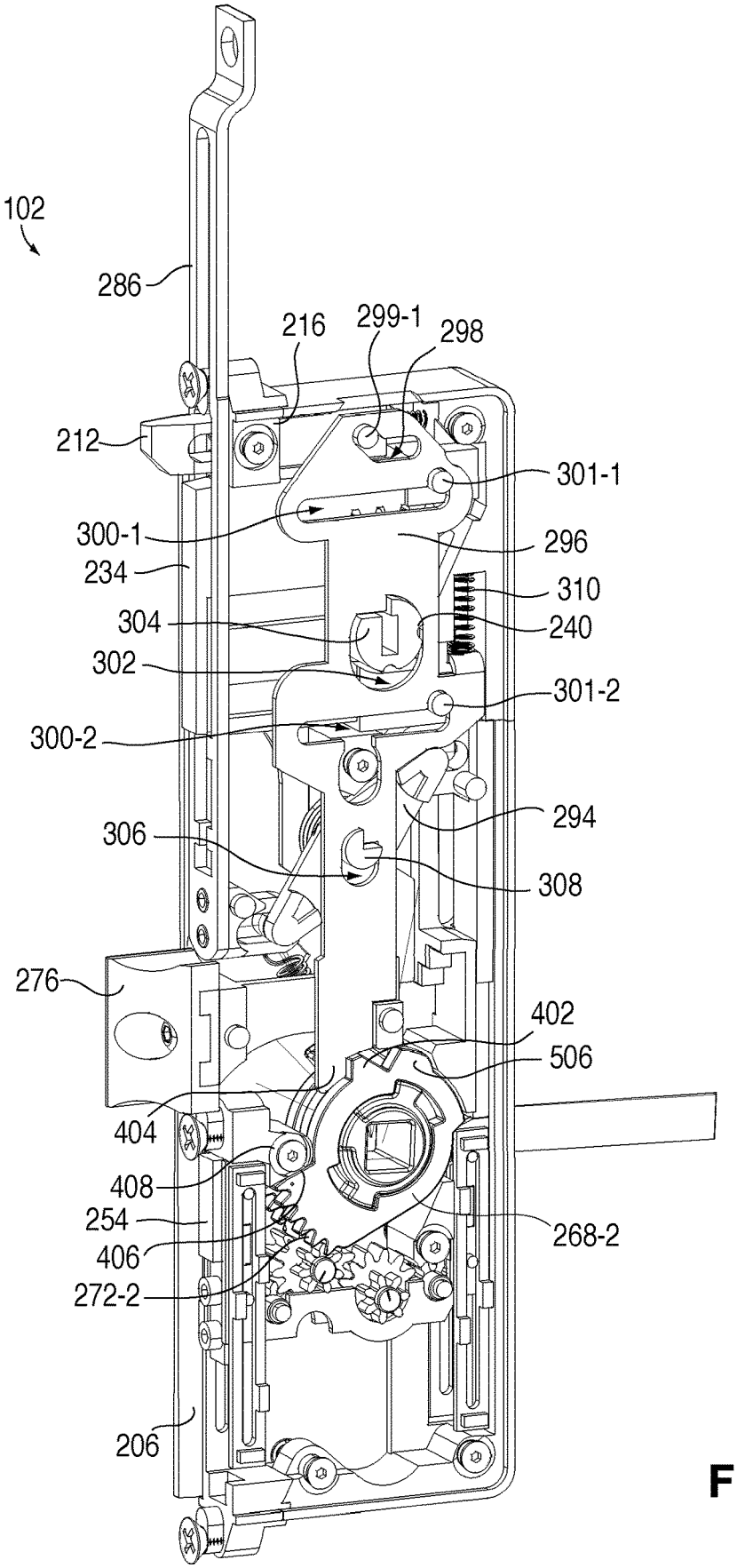
Figure 5:
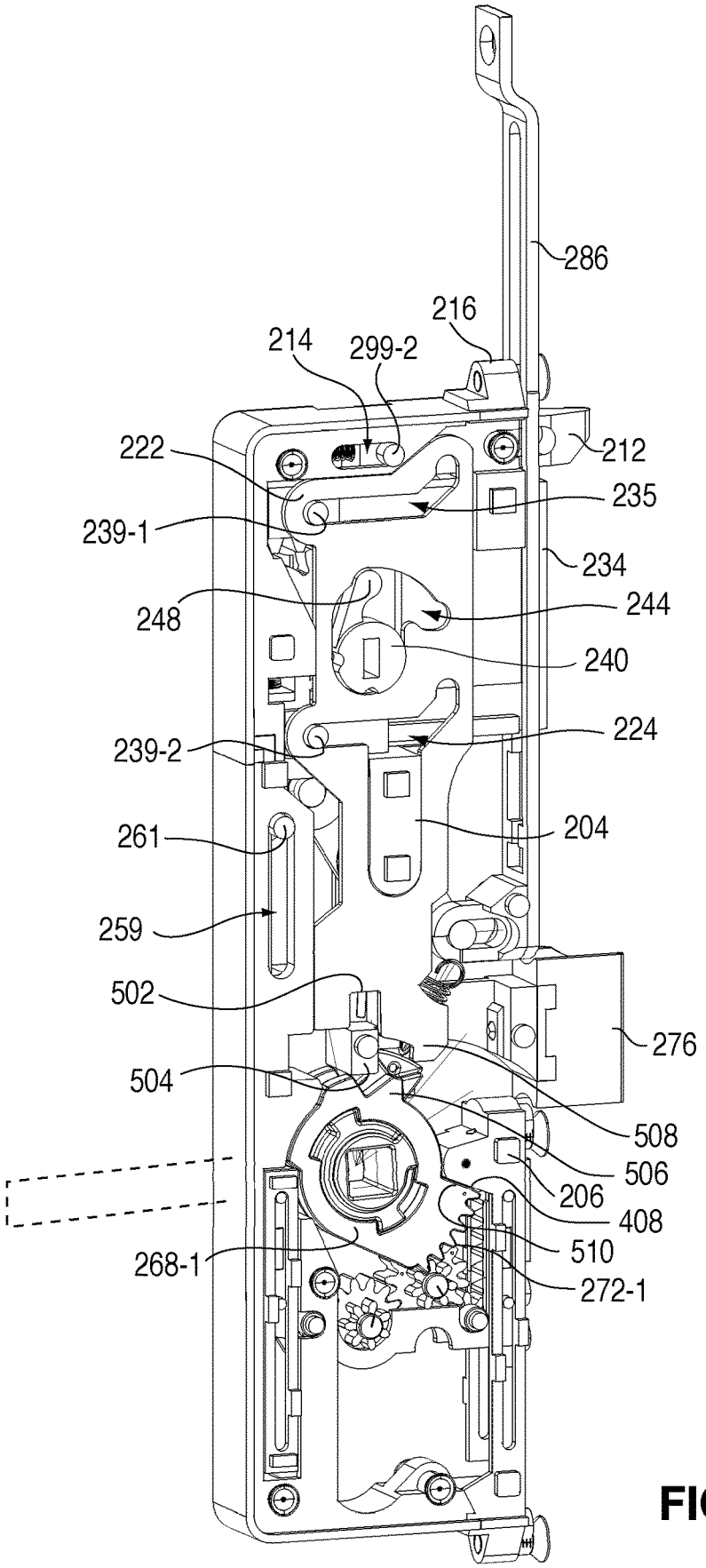

FIGS. 2-1 and 2-2 are exploded views of active panel center gearbox 102 from different angles in examples of the present disclosure. FIG. 3 shows certain assemblies from active panel center gearbox 102 in examples of the present disclosure. FIGS. 4 and 5 are front and back perspective views of assembled active panel center gearbox 102 at an initial "open" state with a mishandling bolt 212 extended from the gearbox, a latch head 276 extended from the gearbox, a deadbolt 234 retracted into the gearbox, a front lower drive bar 254 (to a lower extension 104) retracted (raised), and an upper drive bar 286 (to an upper extension 106 or mid extension 108) retracted (lowered) in examples of the present disclosure. This may be the state of active panel center gearbox 102 when an active panel fitted with the gearbox is ajar.

Active panel center gearbox 102 includes rivet nuts or screw posts 202-1,202-2, 202-3, 202-4, and 202-5 (collectively "rivet nuts 202"), a latch return spring post 204, a center insert 206, and a rack guide 208 fixed to a backset case 210. For example, rivet nuts 202, latch return spring post 204, center insert 206, and rack guide 208 have rivet features that are inserted through openings in backset case 210 and then peened.

A first infill 218 and a second infill 220 are fixed to backset case 210. For example, first infill 218 has a hole 219 that fits over rivet nut 202-2, and first infill 218 has rivet features that are inserted through openings in backset case 210 and then peened. Similarly second infill 220 has holes 221 that fit over rivet nuts 202-3, 202-4, 202-5, and second infill 220 has rivet features that are inserted through openings in backset case 210 and then peened. Although illustrated as separate elements, infills 218 and 220 may be integrated as a single element.

A mishandling bolt 212 defines a horizontal slot 213 along its length and two horizontal pins 299-1 and 299-2 on opposing sides behind horizontal slot 213. Horizontal slot 213 fits over rivet nut 202-1 and horizontal pin 299-2 is inserted through a horizontal slot 213 on first infill 218 and into a horizontal slot 214 on backset case 210. A mishandling bolt bracket 216 fits over mishandling bolt 212 and is fixed to backset case 210. For example, mishandling bolt bracket 216 has a screw hole 217 that allows it to be fastened to rivet nut 202-1, and mishandling bolt bracket 216 has a rivet feature that is inserted through an opening in backset case 210 and then peened. As described, mishandling bolt 212 is limited to a horizontal travel.

A block plate 222 is placed in the case assembly in its upper position with its top against first infill 218. Block plate 222 defines a guide 224 with a vertical guide that fits over an upper block 225 of latch return spring post 204. Guide 224 further includes a slot that includes a horizontal portion in communication with the vertical guide, an inclined portion, and a vertical portion. A latch return spring 226 has a coiled portion that fits over a lower mandrel 227 of latch return spring post 204, and latch return spring 226 has one free end resting against upper block 225 of latch return spring post 204. A spindle return spring 228 has one end fixed to a loop 230 extending from backset case 210. A mishandling bolt spring 232 is placed between the back of mishandling bolt 212 and first infill 218. Mishandling bolt spring 232 is spring-loaded to extend mishandling bolt 212 from active panel center gearbox 102.

A deadbolt 234 is placed in the case assembly in its retracted position with its top against a horizontal surface of mishandling bolt bracket 216, its bottom against a top surface of latch return spring post 204, and its back against first infill 218. On its backside, deadbolt 234 has an upper pin 239-1 inserted through a slot 235 of block plate 222 and into a horizontal slot 236-1 of backset case 210, and deadbolt 234 has a lower pin 239-2 inserted through an upper portion of guide 224 on block plate 222 and into a horizontal slot 236-2 on backset case 210. Slot 235 has a horizontal portion, an inclined portion, and a vertical portion. As described, deadbolt 234 is limited to a horizontal travel.

Deadbolt 234 has the general shape of a sideway U with an upper leg 237 having a downward rack 238. A deadbolt drive 240 is placed in the U-shaped opening of deadbolt 234 so its gear teeth 242 engage downward rack 238. Deadbolt drive 240 extends deadbolt 234 from active panel center gearbox 102 when it is rotated by a key cylinder or a thumb turn from a vertical position to a horizontal position as indicated by its tail slot, and vice versa. Deadbolt drive 240 has a shaft 243 that is inserted through an opening 244 of block plate 222 and into an opening 246 of backset case 210. Deadbolt drive 240 also has an arm 248 extending axially from shaft 243 (better viewed from FIG. 5) that engages an upper, curved edge of opening 244 of block plate 222. Arm 248 is set back from the end of shaft 243 so only the end of shaft 243 is inserted into opening 246 of backset case 210. When installed in an active panel, a lock cylinder engages deadbolt drive 240 from the exterior side of the panel and a thumb turn engages deadbolt drive 240 from the interior side of the panel.

A lower drive assembly 250 (FIG. 3) includes a rear lower drive bar 252 and a front lower drive bar 254 fixed and offset from each other by connection plates 256. For example, rear lower drive bar 252 and front lower drive bar 254 have rivet features that are inserted through openings in connection plates 256 and then peened. The lower end of rear lower drive bar 252 and front lower drive bar 254 have respective inward facing racks 257 and 258. Front lower drive bar 254 is to be coupled to a lower extension to active secondary locks.

Lower drive assembly 250 (FIG. 3) is placed in the case assembly in its retracted (raised) position with the top of rear lower drive bar 252 against the lower end of first infill 218 and the top of front lower drive bar 254 against the top end of center insert 206. In lower drive assembly 250, rear lower drive bar 252 has an upper pin 261 (FIG. 2-2) passing through a vertical slot 259 of second infill 220 and into a vertical slot 260 of backset case 210. Rear lower drive bar 252 also has two lower pins inserted through a vertical slot of rack guide 208. In a symmetrical arrangement, front lower drive bar 254 has two pins inserted in a vertical slot of center insert 206. As described, lower drive assembly 250 is limited to a vertical travel. Although illustrated as many elements, lower drive assembly 250 may be integrated as a single element or a less number of elements.

A gear train 262 connects inward facing racks 257 and 258 of lower drive assembly 250 (FIG. 3). Gear train 262 includes two pinion gears 264-1, 264-2 and two dual gears 266-1, 266-2 that all have shafts inserted into corresponding openings on backset case 210. Pinion gears 264-1 and 264-2 engage inward facing racks 257 and 258, respectively. Dual gears 266-1 and 266-2 each has a center gear fixed with two smaller side gears with all three gears sharing the same rotation axis. Dual gears 266-1 and 266-2 interconnect pinion gears 264-1 and 264-2 through their center gears.

A first drive ring 268-1 is placed in the case assembly concentric with an opening 270 in backset case 210, and its gear teeth 272-1 engaged to a side gear of dual gear 266-2. A spindle drive or drive hub 274 is placed in the case assembly concentric with drive ring 268-1 and opening 270 in backset case 210. On its backside, spindle drive 274 has a large shaft with two diametrically opposed keys and a concentric small shaft with a key that is orthogonal to the other two keys. The large shaft of spindle drive 274 fits in drive ring 268-1 with the two key of the large shaft received in corresponding enlarged keyways of drive ring 268-1. The smaller shaft of spindle drive 274 fits in opening 270 of backset case 210 with the key of the small shaft received in a corresponding enlarged keyway. An arm 275 of spindle drive 274 is connected to the lower end of spindle return spring 228. Spindle return spring 228 is spring-loaded to return spindle drive 274 to a rest position where a connected lever would be level.

A latch head 276 is fastened to a latch body 278 with a screw to form a latch bolt. On its backside, latch body 278 has two pins 279 (FIG. 2-2) that insert into horizontal slots 280-1 and 280-2 on backset case 210. As described, the latch bolt with latch head 276 and latch body 278 is limited to a horizontal travel. The backend of latch body 278 rests against the lower end of latch return spring 226, which is spring-loaded to extend latch head 276 from active panel center gearbox 102. Although illustrated as separate elements, latch head 276 and latch body 278 may be integrated as a single element.

On its front side, spindle drive 274 also has a large shaft with two diametrically opposed keys and a concentric small shaft with a key that is orthogonal to the other two keys, and a square opening is defined through spindle drive 274 through the small shafts. When installed in an active panel, a lever or an entry handle system engages the square opening of spindle drive 274 from the exterior of the active panel, and a lever engages the square opening of spindle drive 274 from the interior of the active panel. A second drive ring 268-2 is placed around the large shaft of spindle drive 274. Drive ring 268-2 has enlarged keyways that receive the two keys from the large shaft of spindle drive 274 in a symmetrical fashion to drive ring 268-1. Teeth 272-2 of drive ring 268-2 is engaged to a side gear of dual gear 266-2.

An upper drive assembly 282 (FIG. 3) is placed in the case assembly in its retracted (lowered) position. Upper drive assembly 282 includes a drive bar cup 284 fixed to the lower end of upper drive bar 286. For example, drive bar cup 284 has rivet features that are inserted through openings in upper drive bar 286 and then peened. Drive bar cup 284 has a pin 288 that is inserted into a vertical slot 290 of backset case 210, and upper drive bar 286 has a vertical slot 292 that receives mishandling bolt 212. As described, upper drive assembly 282 is limited to a vertical travel. Upper drive bar 286 may be connected to upper or mid extensions to active secondary locks. Although illustrated as many elements, upper drive assembly 282 may be integrated as a single element or a less number of elements.

A reverse action rocker 294 has a shaft inserted into a hole in latch return spring post 204 so it can pivot. Reverse action rocker 294 also has one end with a pin inserted into a hole at the upper end of rear lower drive bar 252 of lower drive assembly 250 (FIG. 3), and another end with a pin inserted into a hole of drive bar cup 284 of upper drive assembly 282. Reverse action rocker 294 couples lower drive assembly 250 to upper drive assembly 282 so they translate in different (e.g., opposite) direction.

A mishandling plate return spring 310 is seated in first infill 218 and spring-loaded to lower mishandling plate 296. Mishandling plate 296 is placed in the case assembly in its lower position with its bottom against a lobe 402 of drive ring 268-2. Mishandling plate 296 defines a slot 298 that receives a pin 299-1 on mishandling bolt 212, a slot 300-1 that receives a pin 301-1 on deadbolt 234, a guide 300-2 that receives a pin 301-2 on deadbolt 234, a vertical guide 302 that receives a shaft 304 of deadbolt drive 240, and a vertical guide 306 that receives a shaft 308 of reverse action rocker 294. Slot 298 has an inclined portion and a horizontal portion. Slot 300-1 has a vertical portion and a horizontal portion. Guide 300-2 has a slot with a vertical portion and a horizontal portion that receives pin 301-2. In communication with the horizontal slot portion, guide 300-2 further has a vertical guide that accommodates an upper portion of latch return spring post 204. As described, mishandling plate 296 is limited to a vertical travel.

Rack guides 312-1 and 312-2 are fixed to a backset cover 314. For example, rack guides 312-1 and 312-2 have rivet features that are inserted through openings in backset cover 314 and then peened. Rack guides 312-1 and 312-2 define slots that receive pins on rear lower drive bar 252 and front lower drive bar 254. Backset cover 314 is fixed to the case assembly with screws. Backset cover 314 has a horizontal slot 316 that receives pin 299-1 on mishandling bolt 212, horizontal slots 318-1 and 318-2 that receive pins 301-1 and 301-2 on deadbolt 234, a hole 320 that receives shaft 304 of deadbolt drive 240, a vertical slot 322 that receives an upper pin 323 of rear lower drive bar 252, a vertical slot 324 that receives a pin 325 of drive bar cup 284, horizontal slots 326-1 and 326-2 that receive two pins 328 on latch body 278, and an opening 330 that receives a smaller shaft of spindle drive 274.

Open State

FIGS. 4 and 5 are front and back views of assembled active panel center gearbox 102 at the initial open state with mishandling bolt 212 extended from the gearbox, latch head 276 extended from the gearbox, deadbolt 234 retracted into the gearbox, front lower drive bar 254 retracted (raised), and upper drive bar 286 retracted (lowered) in examples of the present disclosure. In this state, mishandling plate 296 (FIG. 4) is in its lower position and block plate 222 (FIG. 5) is in its upper position.

Referring to FIG. 4, when extended, mishandling bolt 212 has its pin 299-1 at the end of the inclined portion of slot 298 in mishandling plate 296, which places mishandling plate 296 in its lower position. Mishandling bolt return spring 232 is seated in first infill 218 and spring-loaded to extend mishandling bolt 212.

In its lower position, mishandling plate 296 prevents deadbolt 234, deadbolt drive 240, reverse action rocker 294, and drive ring 268-2 from moving. Specifically, deadbolt 234 cannot extend horizontally because pins 301-1 and 301-2 are respectively located in the end of the vertical portions of slot 300-1 and the end of the vertical slot portion of guide 300-2 in mishandling plate 296. Deadbolt drive 240 cannot rotate to horizontally extend deadbolt 234 because a keyway in its shaft 304 is engaged with a key from vertical guide 302 of mishandling plate 296. Reverse action rocker 294 cannot rotate to vertically extend lower drive assembly 250 (FIG. 3) and upper drive assembly 282 (FIG. 3) because a keyway in its shaft 308 is engaged with a key from vertical guide 306 of mishandling plate 296. Drive ring 268-2 cannot rotate in one direction to vertically extend lower drive assembly 250 and upper drive assembly 282 because a lobe 402 of drive ring 268-2 abuts a tab 404 at the lower end of mishandling plate 296. Drive ring 268-2 also cannot rotate in the other direction because a lateral edge 406 of gear teeth 272-2 of drive ring 268-2 abuts a screw post 408 of center insert 206.

Referring to FIG. 5, when raised to its upper position, block plate 222 does not prevent any component (e.g., deadbolt 234, latch head 276, and drive ring 268-1) from moving. Specifically, deadbolt 234 is not restricted by block plate 222 because its pins 239-1 and 239-2 are located in the horizontal slot portion of guide 224 and a horizontal portion of slot 235. Deadbolt drive 240 is not restricted by block plate 222 because arm 248 and shaft 243 of deadbolt drive 240 are not restricted by opening 244 of block plate 222. Reverse action rocker 294 is not restricted by block plate 222 because they do not have any interlocking features. Latch head 276 is not restricted by block plate 222 because a cutout 502 at the bottom of block plate 222 has not engaged a block 504 on latch body 278. Drive ring 268-1 is not restricted by block plate 222 because a lobe 506 of drive ring 268-2 has not engaged a tab 508 at the lower end of block plate 222. Drive ring 268-1 cannot rotate in one direction because it is interconnected through spindle drive 274 to drive ring 268-2, which cannot rotate in the same direction. Like drive ring 268-2, drive ring 268-1 also cannot rotate in the other direction because a lateral edge 510 of gear teeth 272-1 of drive ring 268-1 abuts screw post 408 of center insert 206.

Latched State

Figure 6:
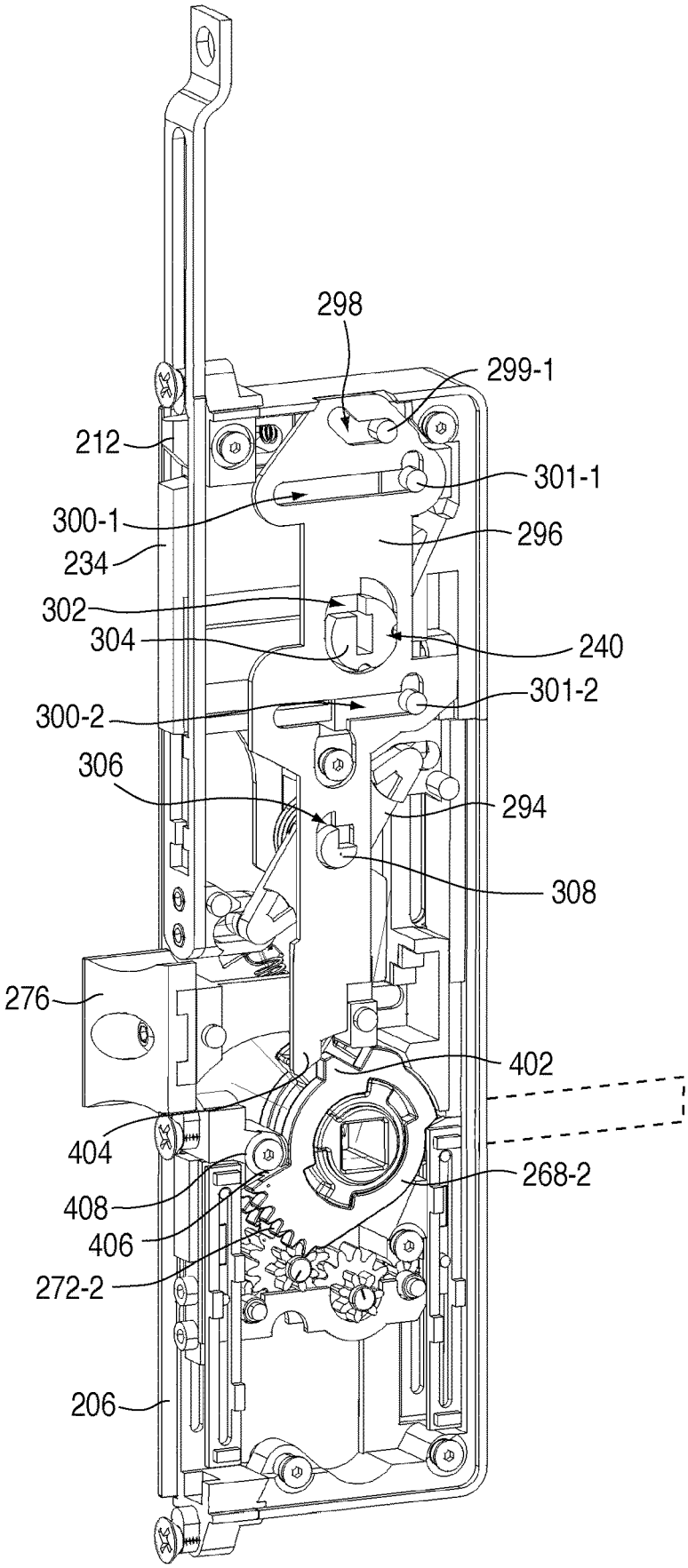
FIG. 6 is a front perspective view of the active panel center gearbox of FIG. 1 at a "latched" state in examples of the present disclosure.

From the open state, active panel center gearbox 102 may transition to a "latched" state with mishandling bolt 212 retracted into the gearbox, latch head 276 extended from the gearbox, and deadbolt 234 retracted into the gearbox. FIG. 6 is a front view of active panel center gearbox 102 at the latched state in examples of the present disclosure. This may be the state of active panel center gearbox 102 when an active panel fitted with the gearbox is closed. In this state, mishandling bolt 212 is pushed by a striker (or a mishandling bolt blocker in a passive panel center gearbox for a passive panel or a mishandling bolt blocker extern in an astragal bridge) into the gearbox to its retracted position, mishandling plate 296 is raised to its upper position, and block plate 222 (FIG. 5) remains in its upper position.

As mishandling bolt 212 retracts, its pin 299-1 travels down the inclined portion and to the end of the horizontal portion of slot 298 in mishandling plate 296, which raises mishandling plate 296 to its upper position.

When raised to its upper position, mishandling plate 296 allows deadbolt 234, deadbolt drive 240, reverse action rocker 294, and drive ring 268-2 to move. Specifically, deadbolt 234 is free to extend horizontally because pins 301-1 and 301-2 are respectively located in the horizontal portion of slot 300-1 and the horizontal slot portion of guide 300-2 in mishandling plate 296. Deadbolt drive 240 is free to rotate to horizontally extend deadbolt 234 because the keyway in its shaft 304 is disengaged from the key from vertical guide 302 of mishandling plate 296. Reverse action rocker 294 is free to rotate to vertically extend lower drive assembly 250 (FIG. 3) and upper drive assembly 282 (FIG. 3) because the keyway in its shaft 308 is disengaged from the key from vertical guide 306 of mishandling plate 296. Drive ring 268-2 is free to rotate in one direction to vertically extend lower drive assembly 250 and upper drive assembly 282 because lobe 402 of drive ring 268-2 does not abut tab 404 at the lower end of mishandling plate 296.

Day Bolt State

Figure 7:
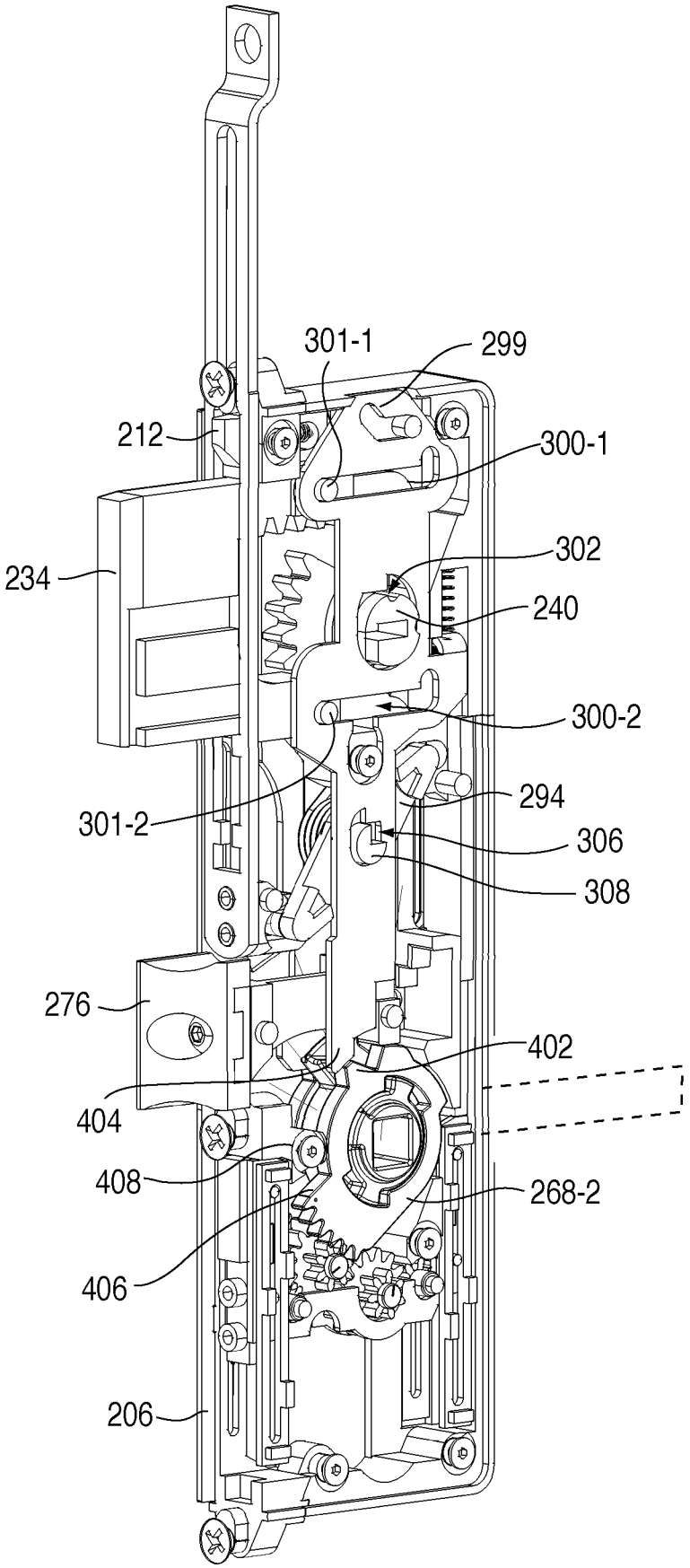
FIGS. 7 and 8 are front and back perspective views of the active panel center gearbox of FIG. 1 at a "day bolt" state in examples of the present disclosure.
Figure 8:
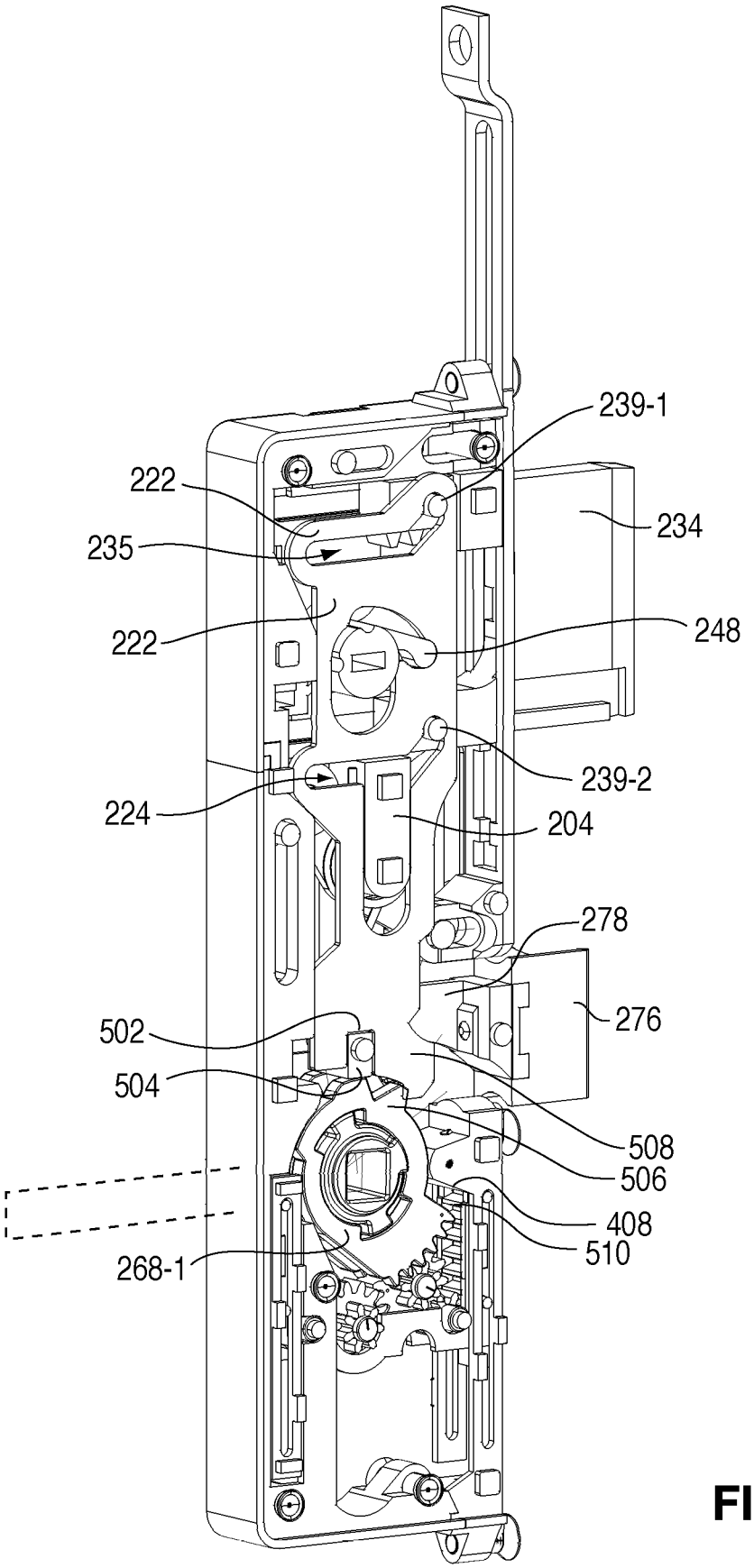

From the latched state, active panel center gearbox 102 may transition to a "day bolt" state with mishandling bolt 212 retracted into the gearbox, latch head 276 extended from the gearbox, deadbolt 234 extended from the gearbox, and assemblies 250 and 282 (FIG. 3) retracted. FIGS. 7 and 8 are front and back views of active panel center gearbox 102 at the day bolt state in examples of the present disclosure. This may be the state of active panel center gearbox 102 when an active panel fitted with active panel center gearbox 102 is closed and the lock cylinder or the thumb turn is turned to extend deadbolt 234. In this state, mishandling plate 296 (FIG. 7) is in its upper position and block plate 222 (FIG. 8) is in its lower position.

Referring to FIG. 7, deadbolt drive 240 is rotated to horizontally extend deadbolt 234 from active panel center gearbox 102. As a result, deadbolt 234 is extended with its pins 301-1 and 301-2 respectively located at the end of the horizontal portion of slot 300-1 and the end of the horizontal slot portion of guide 300-2.

Referring to FIG. 8, when deadbolt drive 240 is rotated to horizontally extend deadbolt 234 from active panel center gearbox 102, pins 239-1 ad 239-2 of deadbolt 234 respectively travel up the inclined portion of slot 235 and the inclined slot portion of guide 224 in block plate 222 to partially lower block plate 222. When block plate 222 is partially lowered, arm 248 of deadbolt drive 240 pushes down on opening 244 in block plate 222 to fully lower block plate 222. In its fully lowered position, block plate 222 prevents deadbolt 234, latch head 276, and drive ring 268-1 from moving. Specifically, deadbolt 234 cannot retract horizontally because its pins 239-1 and 239-2 are respectively located at the end of the vertical portion of slot 235 and the end of the vertical slot portion of guide 224 of block plate 222. Latch head 276 cannot retract horizontally because cutout 502 at the bottom of block plate 222 has engaged block 504 of latch body 278. Drive ring 268-1 cannot rotate in one direction because lobe 506 of drive ring 268-2 has engaged tab 508 at the bottom of block plate 222. As described above, drive ring 268-1 also cannot rotate in the other direction because lateral edge 510 of gear teeth 272-1 of drive ring 268-1 abuts screw post 408 of center insert 206.

Secure State

Figure 9:
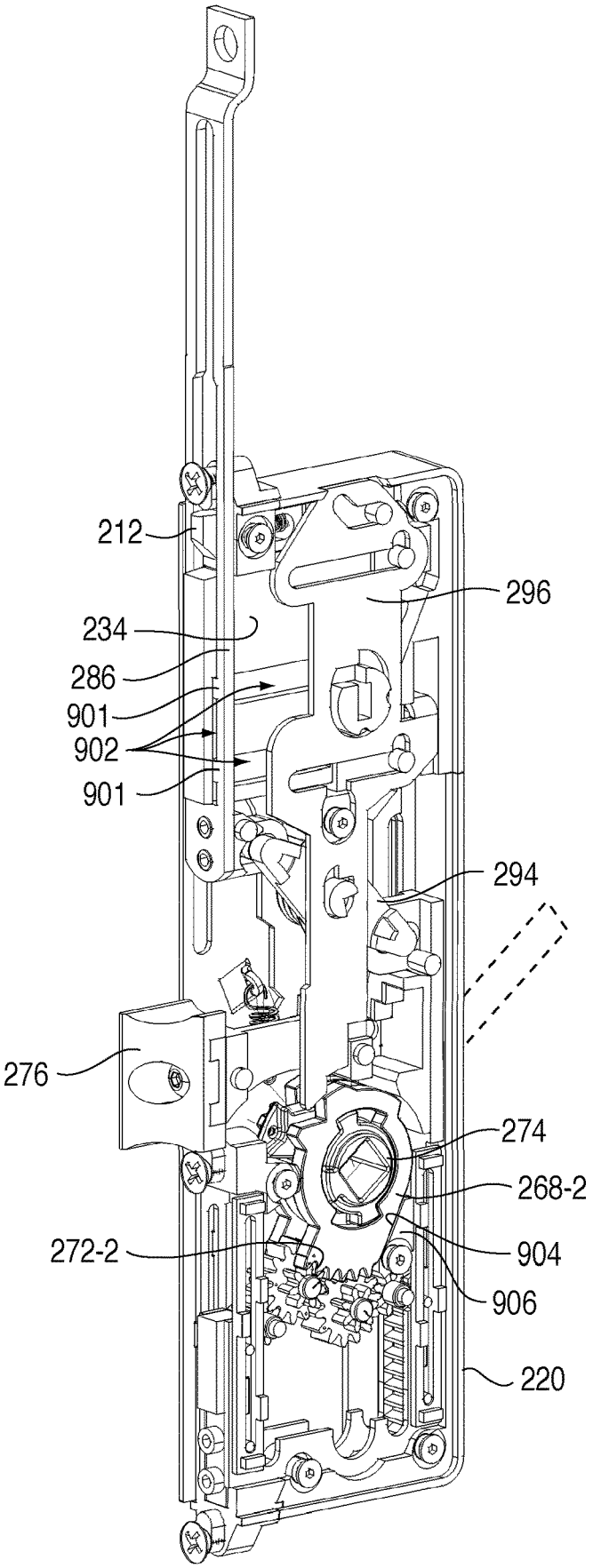
FIGS. 9, 10, 11, and 12 are perspective views of the active panel center gearbox of FIG. 1 at a "secure" state in examples of the present disclosure.
Figure 10:
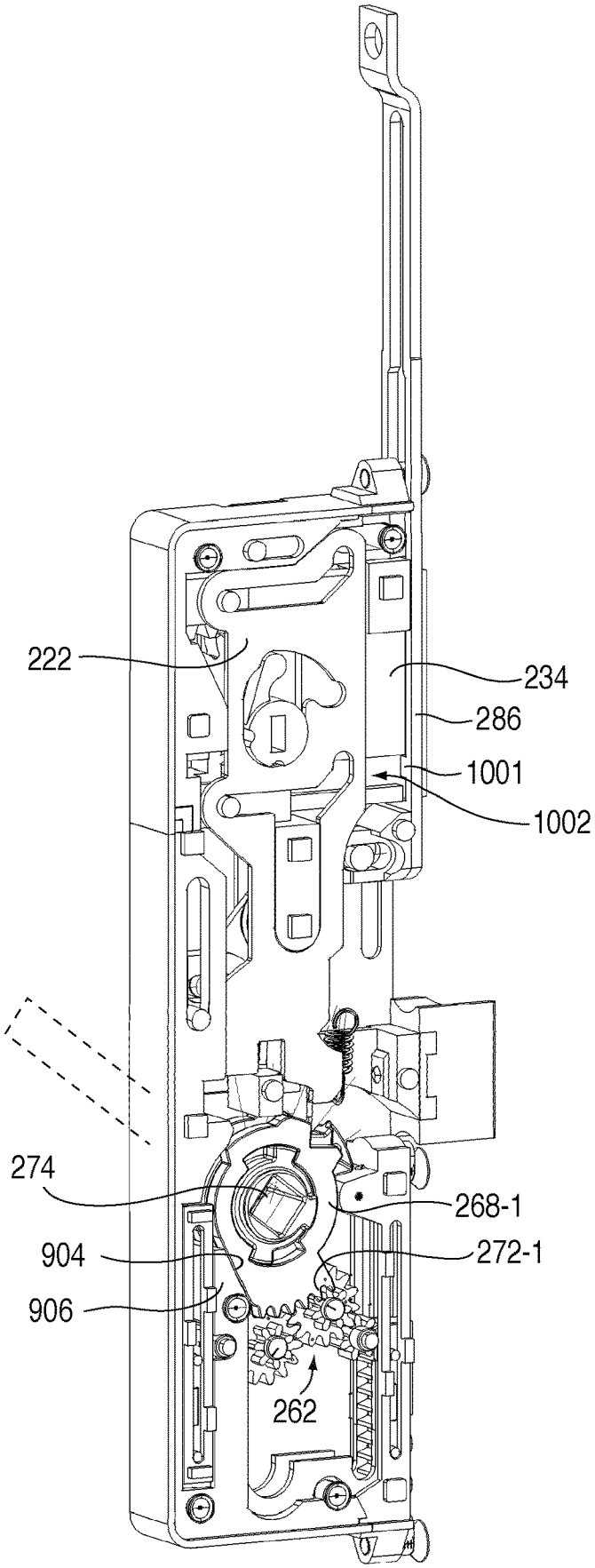

From the latched state, active panel center gearbox 102 may also transition to a "secure" state with mishandling bolt 212 retracted into the gearbox, latch head 276 extended from the gearbox, deadbolt 234 retracted into the gearbox, and assemblies 250 and 282 (FIG. 3) extended. FIGS. 9 and 10 are front and back views of active panel center gearbox 102 in the secured state in examples of the present disclosure. This may be the state of active panel center gearbox 102 when an active panel fitted with the gearbox is closed and the lever is lifted up or an entry handle system is activated to vertically extend assemblies 250 and 282 (FIG. 3).

In the secure state, mishandling plate 296 (FIG. 9) is in its upper position, which has generally been described above with reference to FIG. 7. Referring to FIG. 9, spindle drive 274 is rotated by a lever or an entry handle system. The rotation of spindle drive 274 is transferred to drive rings 268-1 and 268-2, and the rotations of drive rings 268-1 and 268-2 are transferred by gear train 262 to translate lower drive assembly 250 (FIG. 3) downward. The downward motion of lower drive assembly 250 is transferred by reverse action rocker 294 into an upward motion to upper drive assembly 282. As upper drive assembly 282 travels upward, tabs 901 of upper drive bar 286 travel upward through a vertical portion of a locking guide 902 on one lateral face of deadbolt 234. The rotation of drive ring 268-2 reaches an end when an edge 904 of gear teeth 272-2 abuts a stop 906 provided second infill 220.

In the secure state, block plate 222 (FIG. 10) is in its upper position, which has generally been described above with reference to FIG. 5. Referring to FIG. 10, as upper drive assembly 282 (FIG. 3) travels upward, a tab 1001 of upper drive bar 286 travels upward through a vertical portion of a locking guide 1002 on another lateral face of deadbolt 234.

Figure 11:
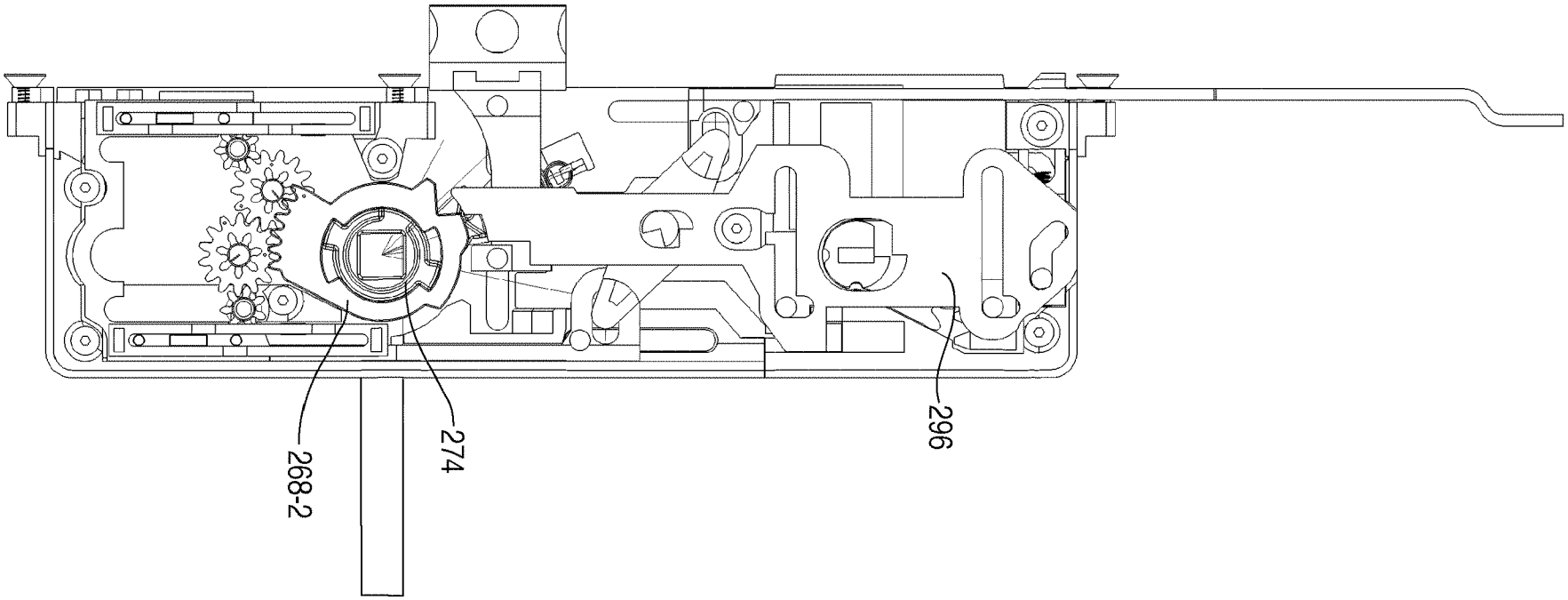
Figure 12:
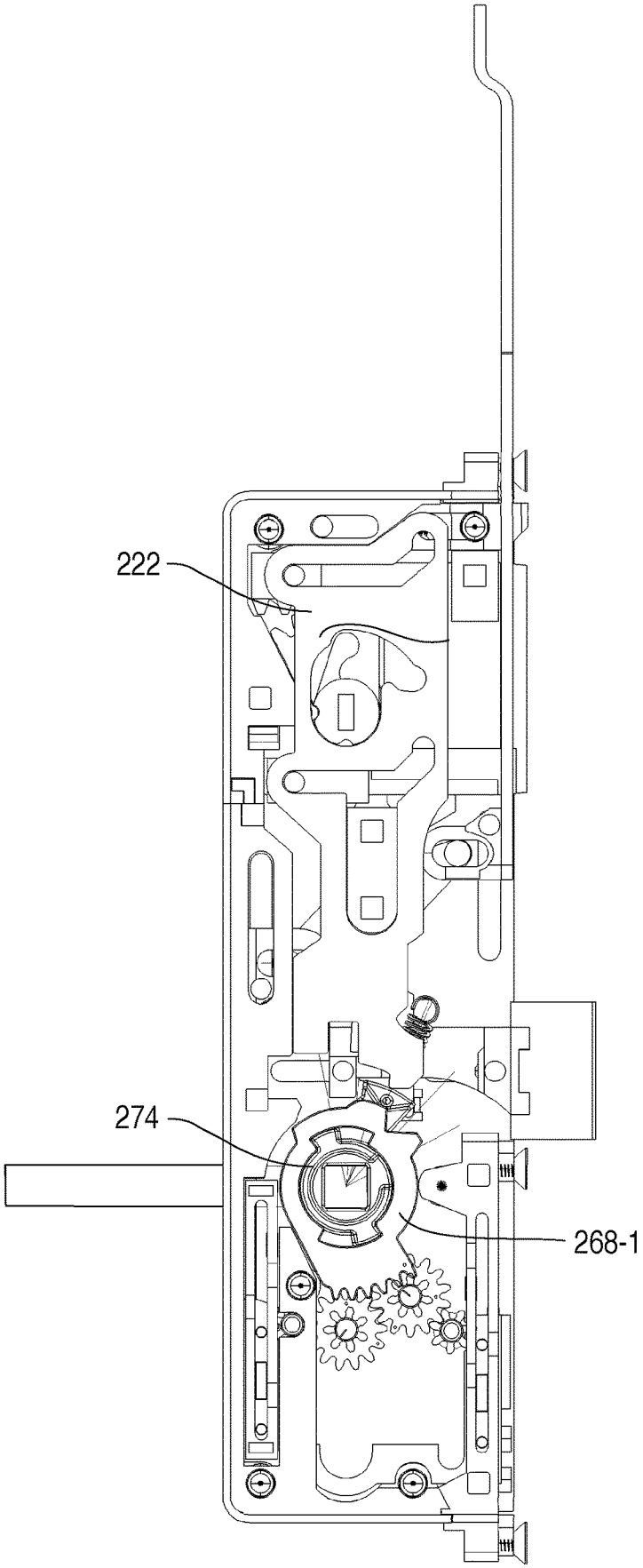

When the lever or entry handle system is released, spindle drive 274 returns to its at rest position made possible by an extension spring 228 connected to loop 230 on the backset case 210 and arm 275 of the spindle drive 274, and free-play provided through enlarged keyways in drive rings 268-1 and 268-2 as shown in FIGS. 11 and 12 in examples of the present disclosure.

Locked State

Figure 13:
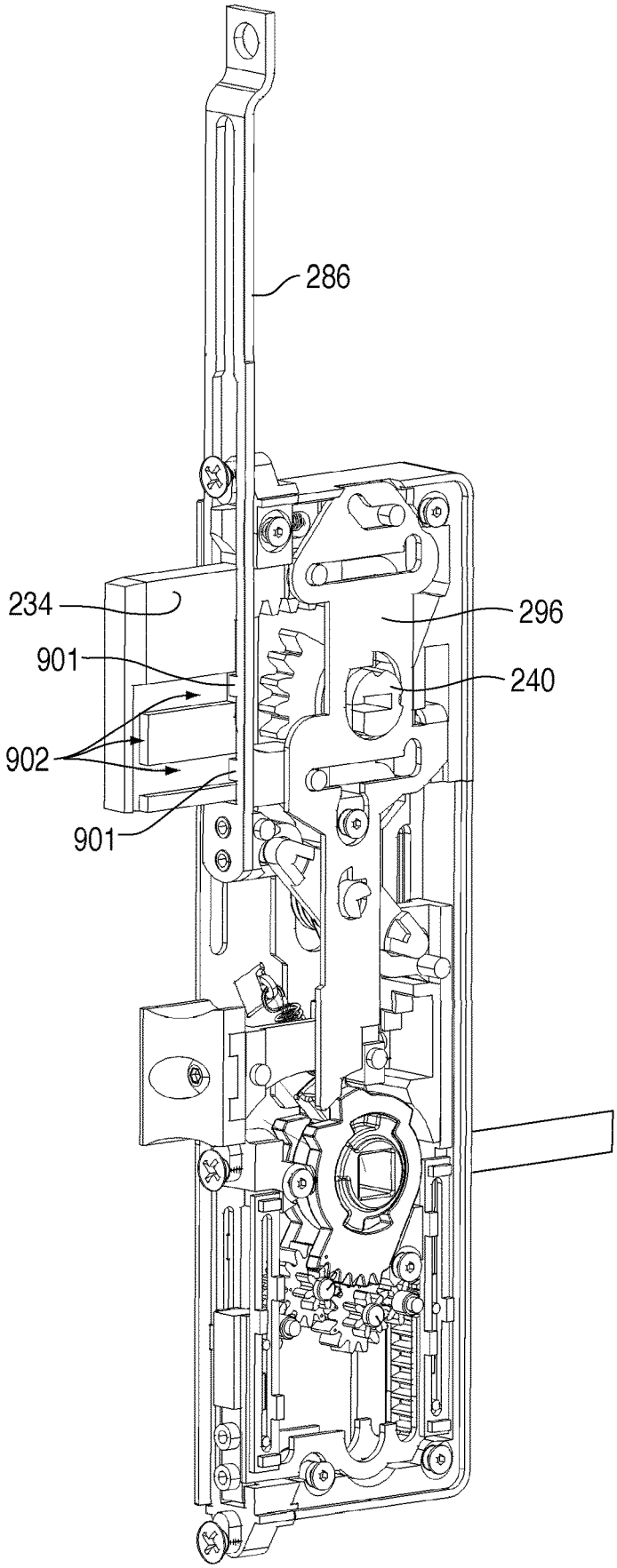
FIGS. 13 and 14 are front and back perspective views of the active panel center gearbox of FIG. 1 at a "loaded" state in examples of the present disclosure.
Figure 14:
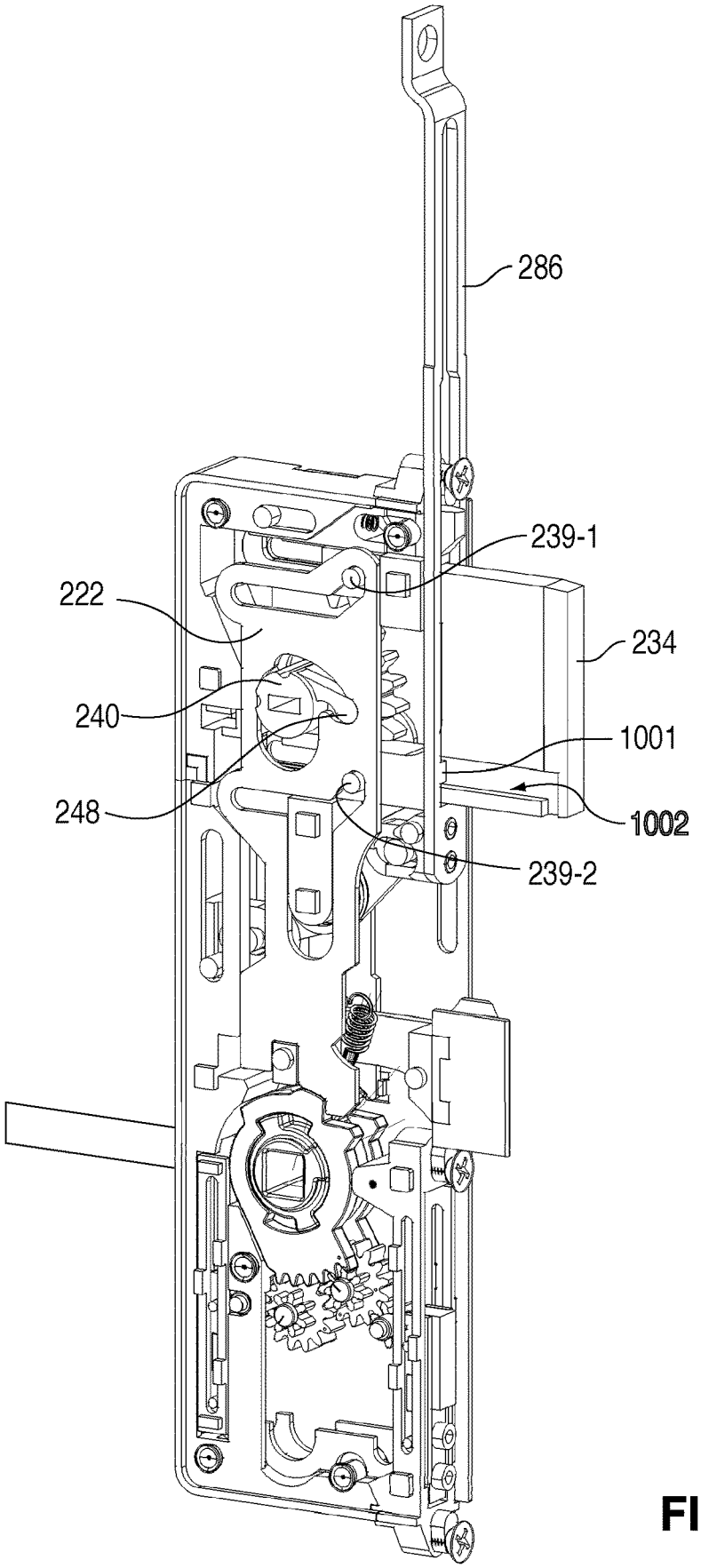

From the secure state, active panel center gearbox 102 may transition to a "locked" state with mishandling bolt 212 retracted into the gearbox, latch head 276 extended from the gearbox, deadbolt 234 extended from the gearbox, and assemblies 250 and 282 (FIG. 3) extended. FIGS. 13 and 14 are front and back views of active panel center gearbox 102 at the locked state in examples of the present disclosure. This may be the state of active panel center gearbox 102 when an active panel fitted with the gearbox is closed, the lever is turned or an entry handle system is activated to extend assemblies 250 and 282, and a lock cylinder or a thumb turn is rotated to extend deadbolt 234.

In the locked state, mishandling plate 296 (FIG. 13) is in its upper position, which has generally been described above with reference to FIG. 6. Referring to FIG. 13, deadbolt drive 240 is rotated to horizontally extend deadbolt 234 from active panel center gearbox 102 as similarly described above with reference to FIG. 7. However, tabs 901 of upper drive bar 286 travel to the end of the horizontal portions of locking guide 902 on deadbolt 234, which prevents upper drive assembly 282 (FIG. 3) from being vertically retracted when deadbolt 234 is horizontally extended.

In the locked state, block plate 222 (FIG. 14) is in its lower position, which has generally been described above with reference to FIG. 8. Referring to FIG. 14, deadbolt drive 240 is rotated clockwise to horizontally extend deadbolt 234 as similarly described above with reference to FIG. 8. However, tab 1001 of upper drive bar 286 travels to the end of the horizontal portion of locking guide 1002 on deadbolt 234, which prevents upper drive assembly 282 (FIG. 3) from being vertically retracted when deadbolt 234 is horizontally extended.

Unlatched State

Figure 15:
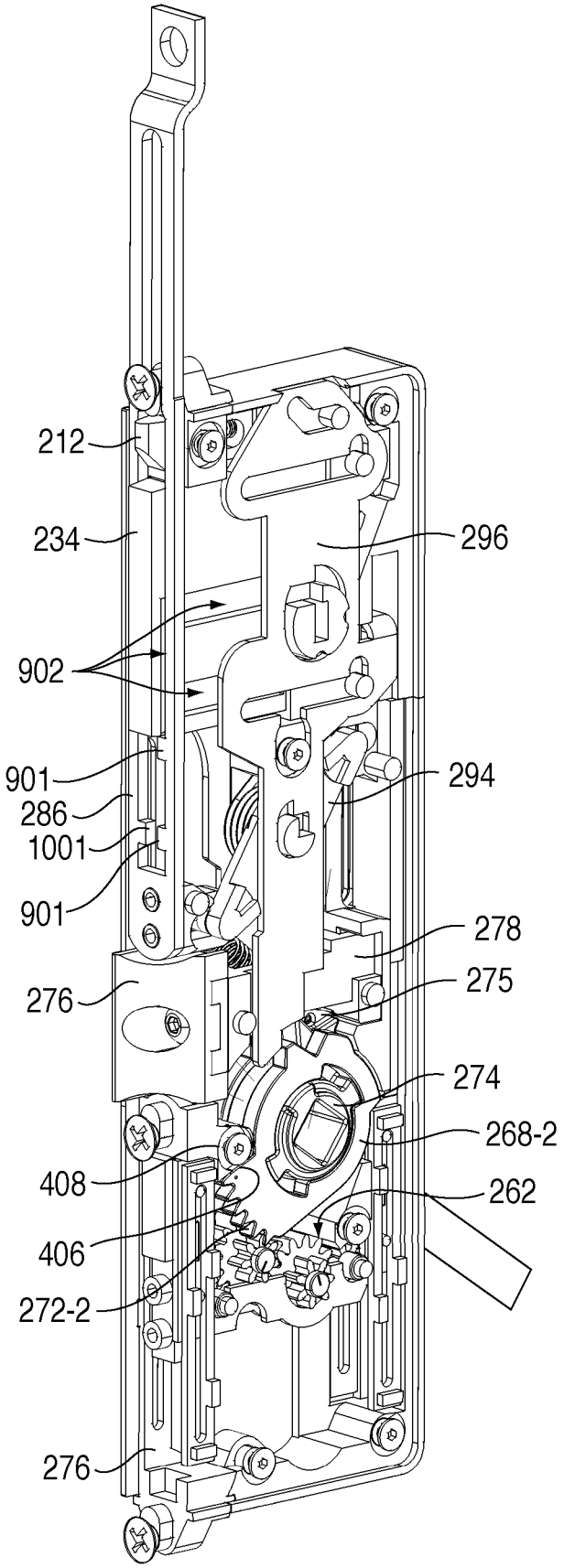
FIGS. 15, 16, 17, and 18 are perspective views of the active panel center gearbox of FIG. 1 at an "unlatched" state in examples of the present disclosure.
Figure 16:
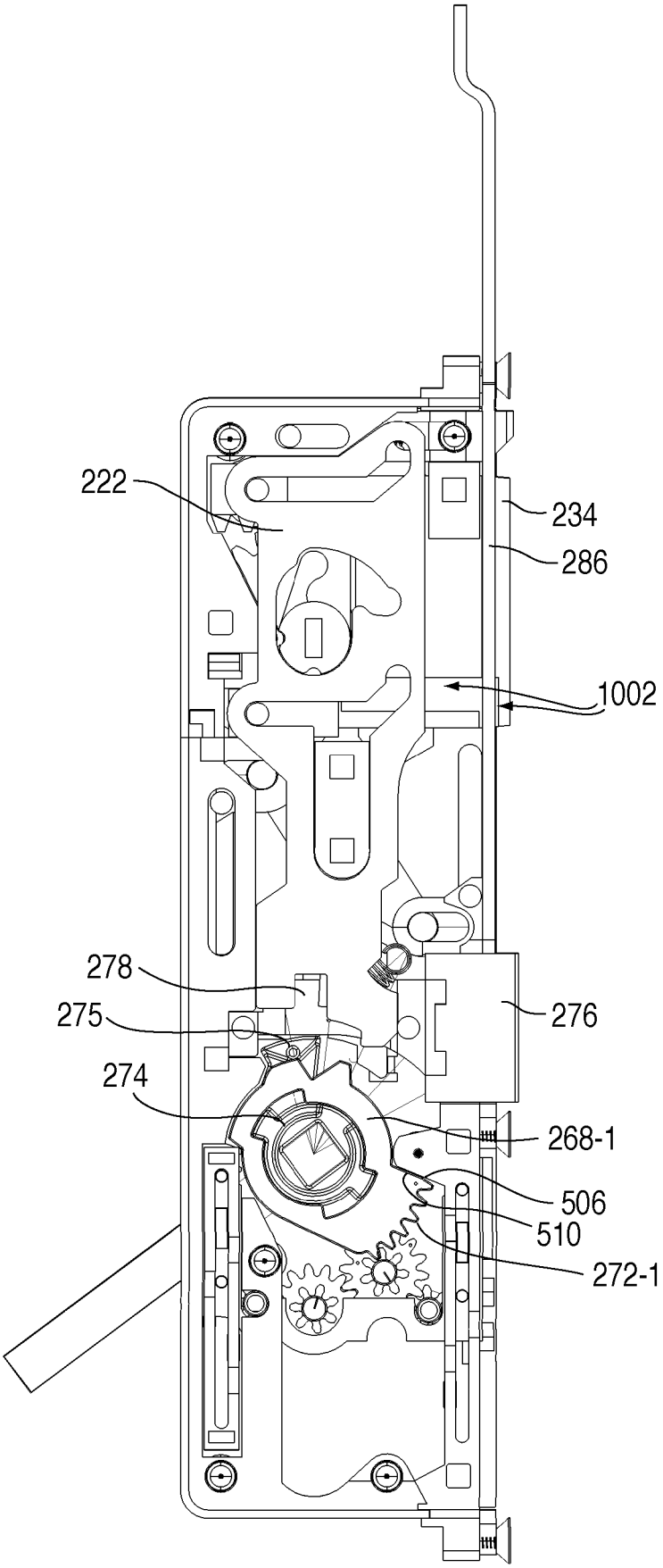

From the secure state, active panel center gearbox 102 may transition to an "unlatched" state with mishandling bolt 212 retracted into the gearbox, latch head 276 retracted into the gearbox, deadbolt 234 retracted into the gearbox, and assemblies 250 and 282 (FIG. 3) retracted. FIGS. 15 and 16 are front and back views of active panel center gearbox 102 in the unlatched state in examples of the present disclosure. This may be the state of active panel center gearbox 102 when an active panel fitted with the gearbox is closed and the lever is pressed down or an entry handle system is activated to retract latch head 276 or assemblies 250, 282.

In the unlatched state, mishandling plate 296 (FIG. 15) is in its upper position, which has generally been described above with reference to FIG. 6. Referring to FIG. 15, spindle drive 274 is rotated clockwise by a lever or an entry handle system. The rotation of spindle drive 274 causes its arm 275 to horizontally retract latch body 278 and latch head 276.

The rotation of spindle drive 274 is also transferred to drive rings 268-1 and 268-2, and the rotations of drive rings 268-1 and 268-2 are transferred by gear train 262 to translate lower drive assembly 250 (FIG. 3) upward. The upward motion of lower drive assembly 250 is transferred by reverse action rocker 294 into a downward motion to upper drive assembly 282. As upper drive assembly 282 travels downward, tabs 901 of upper drive bar 286 travel downward through the vertical portion of locking guide 902 on deadbolt 234. The rotation of drive ring 268-2 reaches an end when lateral edge 406 of gear teeth 272-2 of drive ring 268-2 abuts screw post 408 of center insert 206.

In the unlatched state, block plate 222 (FIG. 16) is in its upper position, which has generally been described above with reference to FIG. 5. Referring to FIG. 16, as upper drive bar 286 travels downward, tab 1001 of upper drive bar 286 travels downward through the vertical portion of locking guide 1002 on deadbolt 234.

Figure 17:
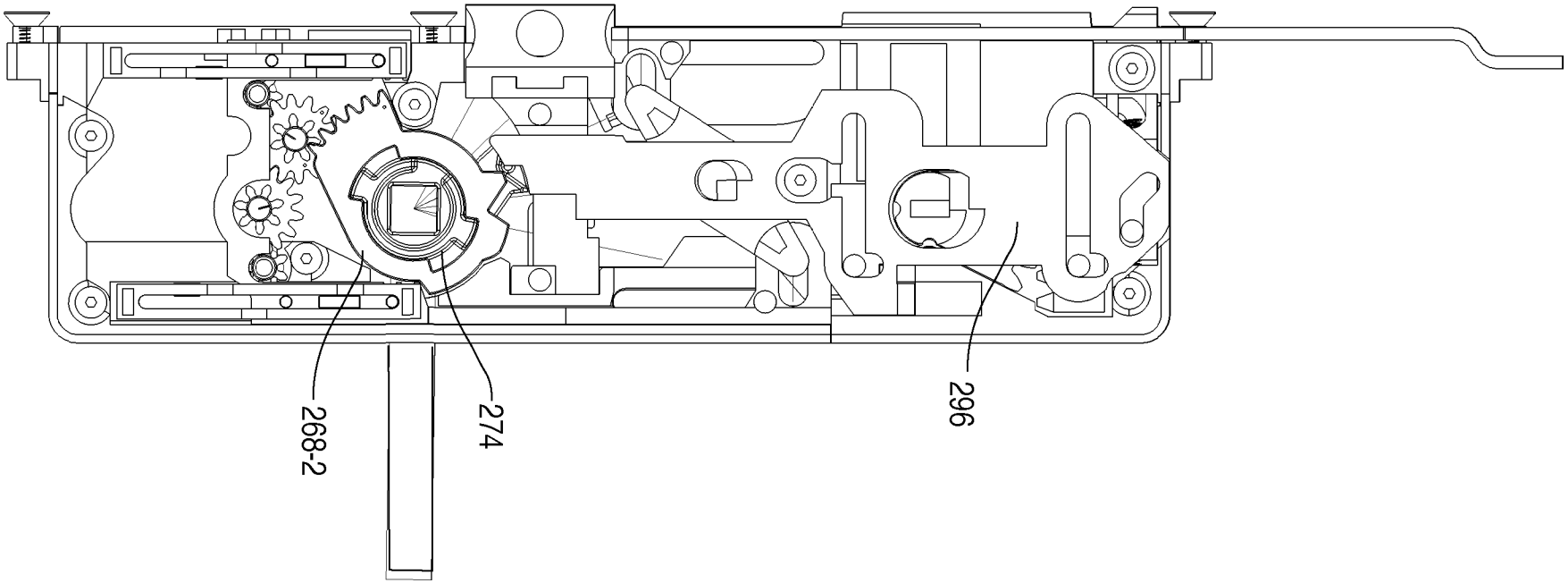
Figure 18:
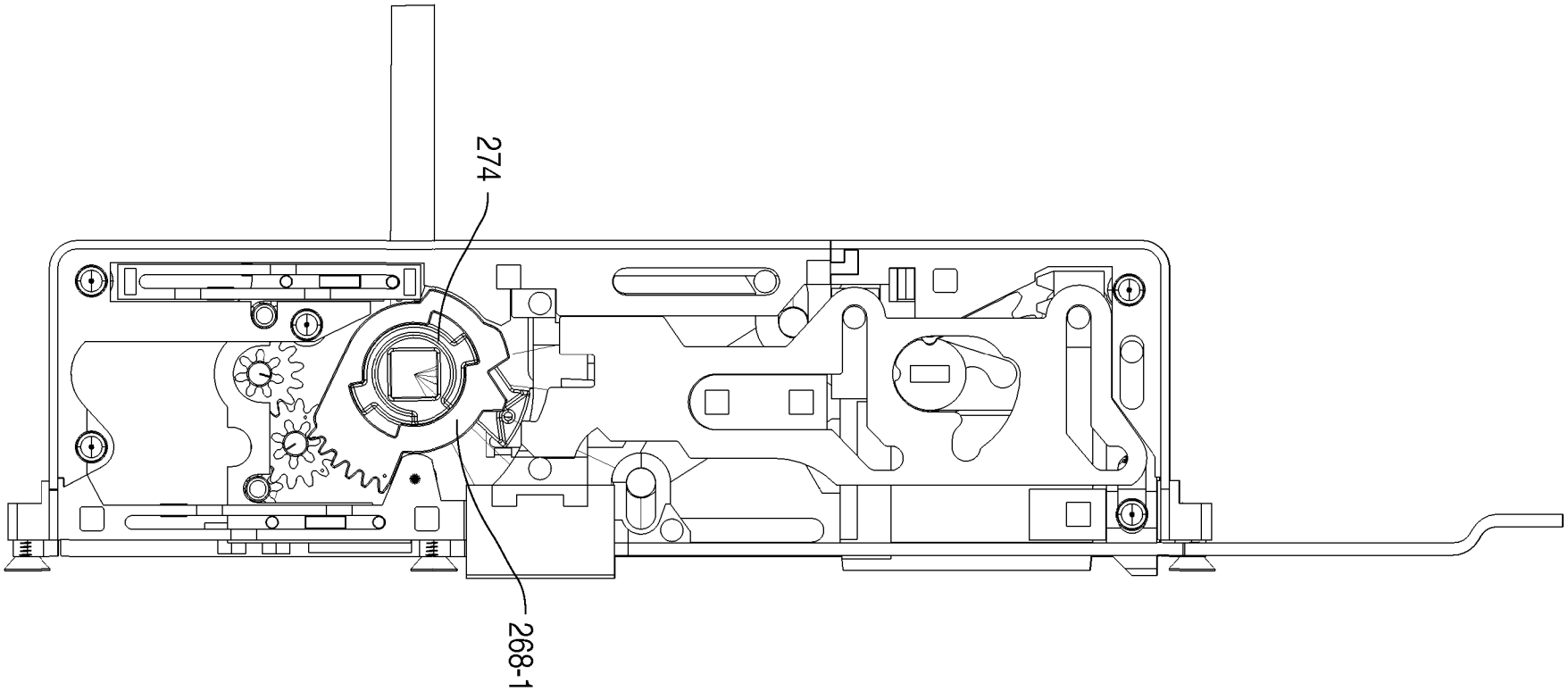

When the lever or entry handle system is released, spindle drive 274 returns to its at rest position made possible by an extension spring 228 connected to loop 230 on the backset case 230 and arm 275 of the spindle drive 274, and free-play provided through enlarged keyways in drive rings 268-1 and 268-2 as shown in FIGS. 17 and 18 in examples of the present disclosure. Note that latch head 276 may be retracted as shown in FIGS. 17 and 18 when latch head 276 runs up a striker.

Passive Panel Lock System

Figure 19:
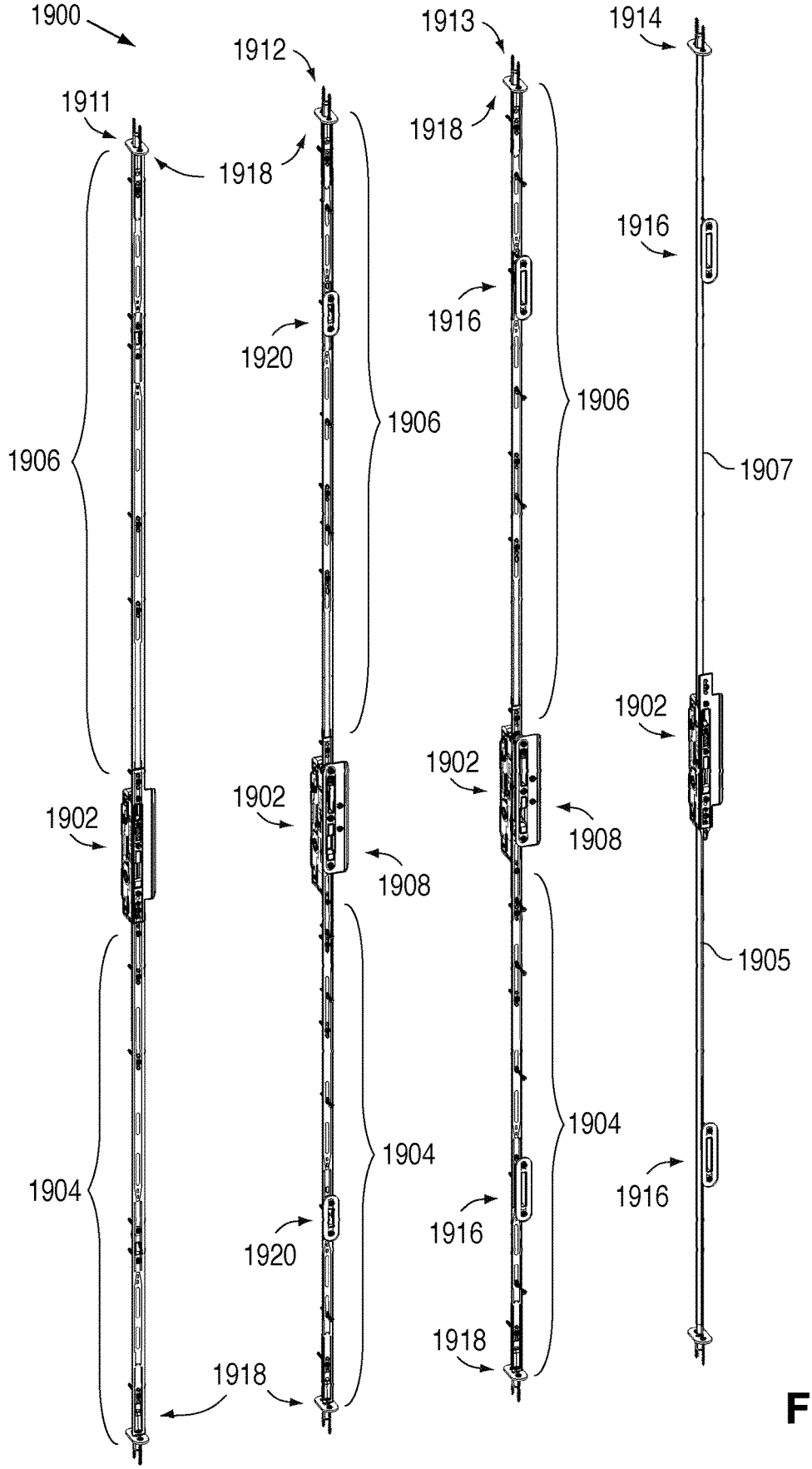
FIG. 19 shows variations of a passive panel lock system in examples of the present disclosure.

FIG. 19 shows variations of a passive panel lock system 1900 for doors in examples of the present disclosure. Passive panel lock system 1900 may be a suite of components that can be selectively assembled to provide passive panels (secondary operating door panels) that work with active panels fitted with active panel lock system 100 (FIG. 1). Each variation of passive panel lock system 1900 includes a passive panel center gearbox 1902, a lower extension 1904 or a lower rod 1905, an upper extension 1906 or an upper rod 1907, an optional astragal bridge 1908, and an optional mid extension (not shown). Passive panel center gearbox 1902 may come in a variety of backsets. Passive panel center gearbox 1902 may be installed at the same height as an active panel center gearbox, such as active panel center gearbox 102 (FIG. 1). Lower extension 1904 and upper extension 1906 may be equipped shoot bolt mechanisms 1918 and strikers that match for the secondary locks in a corresponding variation of active panel lock system 100. An astragal bridge 1908 is fitted to passive panel center gearbox 1902 when a passive panel has an astragal that an active panel rests against when the doors are closed. A mid extension may be added between passive panel center gearbox 1902 and upper extension 1906 to accommodate for greater door heights.

In FIG. 19, four variations 1911, 1912, 1913, and 1914 are illustrated to demonstrate some possible component combinations of passive panel lock system 1900. Variation 1911 includes a passive panel center gearbox 1902, a lower extension 1904 equipped a shoot bolt mechanism 1918, and an upper extension 1906 equipped with a shoot bolt mechanism 1918. Variation 1912 includes a passive panel center gearbox 1902, a lower extension 1904 equipped with a tongue striker 1920 and a shoot bolt mechanism 1918, and an upper extension 1906 equipped with a tongue striker 1920 and a shoot bolt mechanism 1918. Variation 1913 includes a passive panel center gearbox 1902, a lower extension 1904 equipped with a hook striker 1916 and a shoot bolt mechanism 1918, and an upper extension 1906 equipped with a hook striker 1916 and a shoot bolt mechanism 1918. Variation 1914 includes a passive panel center gearbox 1902, a lower rod 1905, and an upper rod 1907. Instead of being located along the edge of a panel like extensions 1904 and 1906, rods 1905 and 1907 are located inside the panel. A mid extension or rod (not shown) may be added between passive panel center gearbox 1902 and upper extension 1906 or upper rod 1907 to accommodate for greater door heights.

Figure 20:
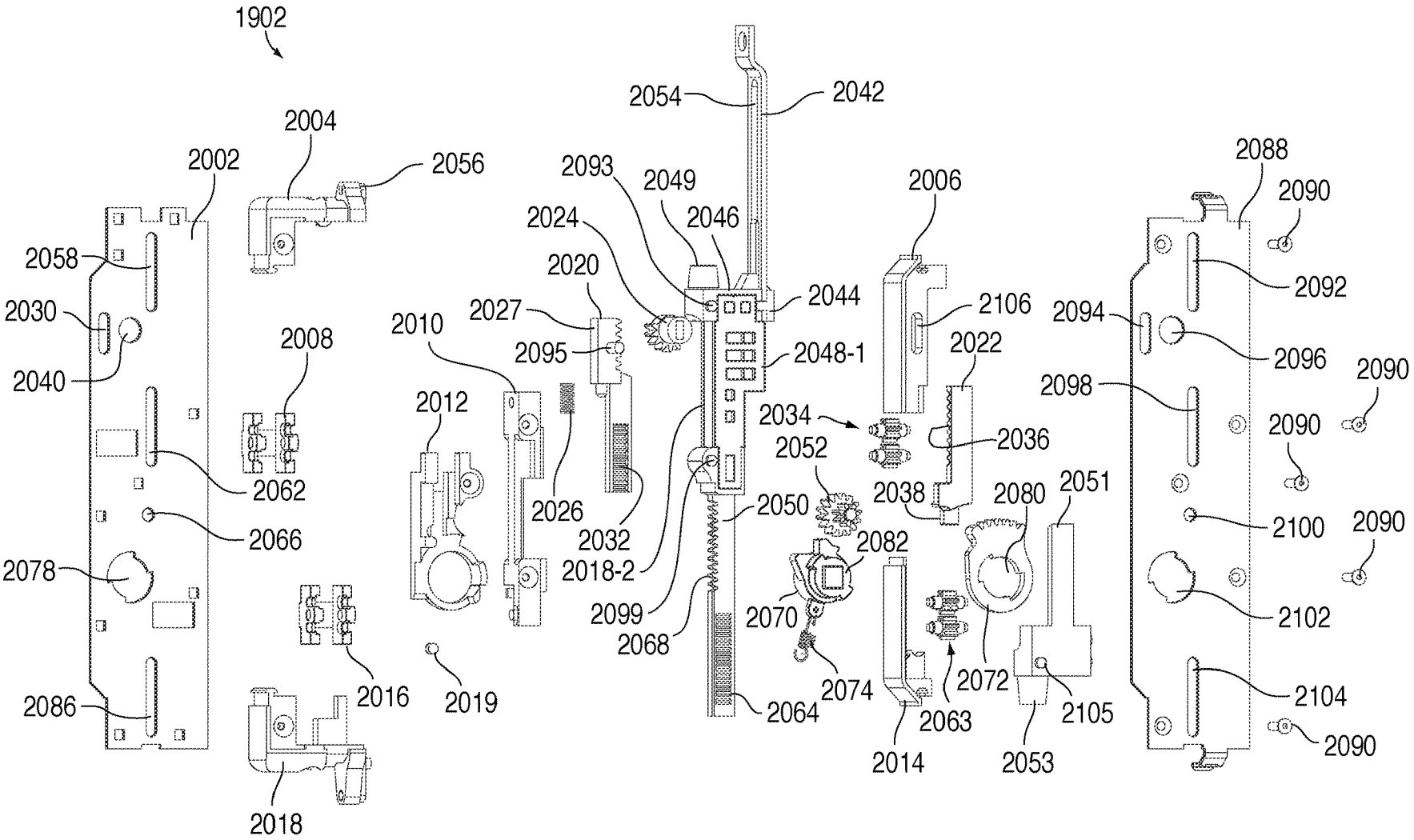
FIGS. 20 and 21 are exploded views of a passive panel center gearbox of FIG. 19 from different angles in examples of the present disclosure.
Figure 21:
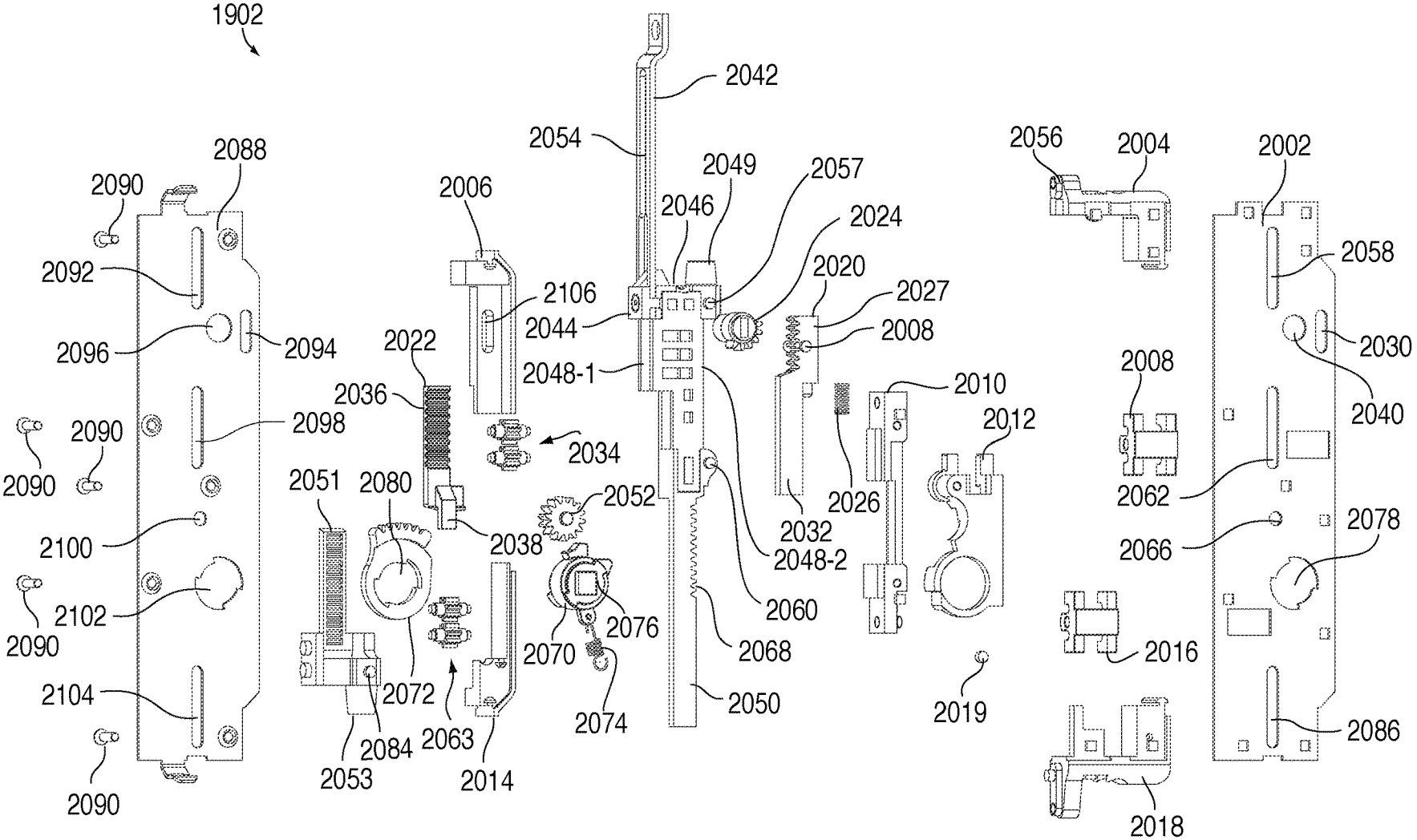
Figure 22:
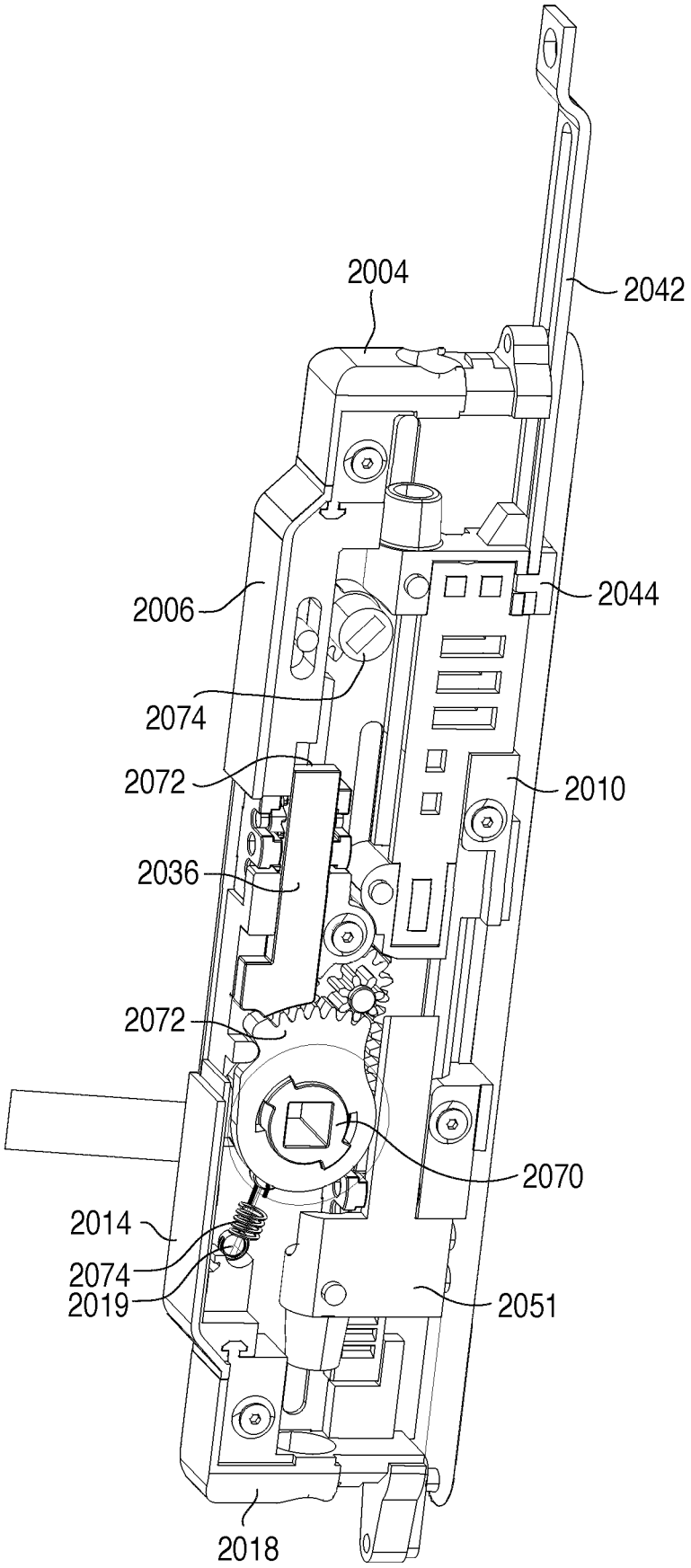
Figures 1, 23:
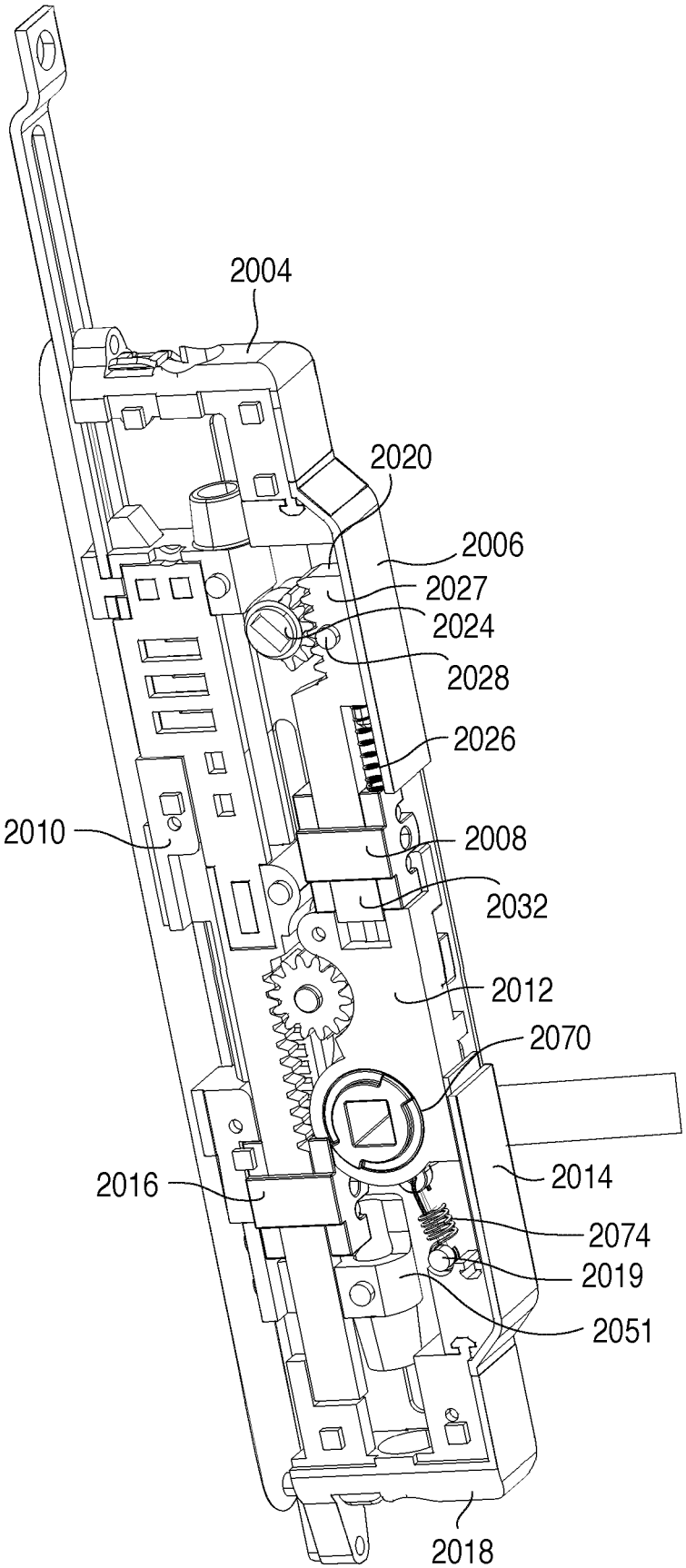
Figures 2, 23:
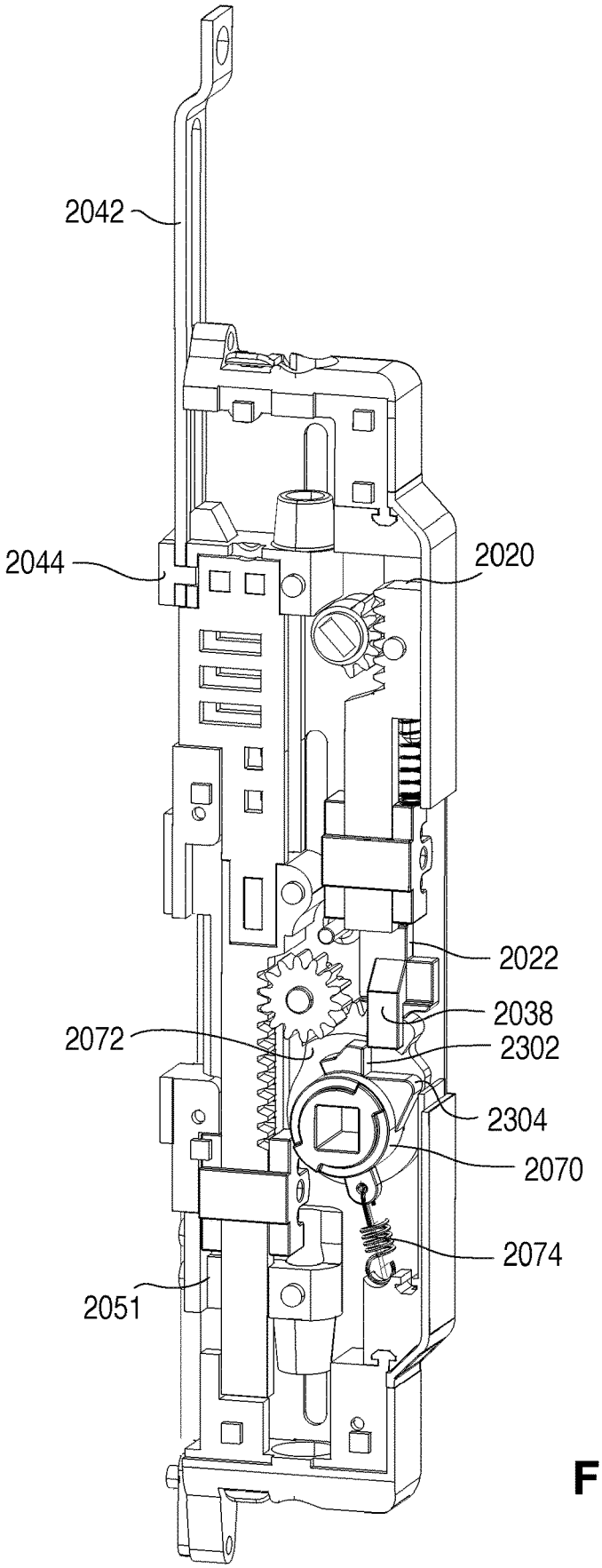

FIGS. 20 and 21 are exploded views of passive panel center gearbox 1902 from different angles in examples of the present disclosure. FIGS. 22 and 23-1 are front and back perspective views of assembled passive panel center gearbox 1902 at a "primed" state with a tail drive 2024 turned at 45 degrees, an upper connection bar 2042 retracted (lowered), a mishandling bolt blocker 2044 retracted (raised), and a lower drive rack 2051 retracted (raised). This may be the state of passive panel center gearbox 1902 when a passive panel fitted with the gearbox is closed and ready to be locked.

Passive panel center gearbox 1902 includes a case assembly with a backset case 2002 and various stationary parts fixed to backset case 2002. The stationary parts include a top screw post 2004, a first infill 2006, a first gear shoe 2008, a first case insert 2010, a second case insert 2012, a second infill 2014, a second gear shoe 2016, and a bottom screw post 2018. A spring pin 2019 is fixed to backset case 2002. The stationary parts have rivet features that are inserted through openings in backset case 2002 and then peened.

A thumb turn assembly includes a first lock bar 2020, a second lock bar 2022, a tail drive 2024, a lock bar spring 2026, and two pinion gears 2034. First lock bar 2020 has a upper block 2027 with a pin 2028 (FIG. 21) inserted into a vertical slot 2030 on backset case 2002, and a lower rack 2032 placed in a vertical channel formed by first gear shoe 2008. As described, first lock bar 2020 is limited to a vertical travel. Pinion gears 2034 are seated in first gear shoe 2008 to engage lower rack 2032. Lock bar spring 2026 is located between the bottom of upper block 2027 and the top of first gear shoe 2008. First lock bar 2020 is spring-loaded to an upper position. Second lock bar 2022 has an upper rack 2036 and a lower leg 2038. Second lock bar 2022 is placed in the case assembly with upper rack 2036 located over pinion gears 2034 in a vertical channel formed by first gear shoe 2008, and the lower portion of upper rack 2036 and lower leg 2038 located in vertical channels provided in second case insert 2012. As described, second lock bar 2022 is limited to a vertical travel. As lower rack 2032 on first lock bar 2020 and upper rack 2036 on second lock bar 2022 are connected by pinion gears 2034, second lock bar 2022 is spring-loaded to return to a lower position. Tail drive 2024 is inserted into a hole 2040 of backset case 2002.

A reverse action assembly includes upper connection bar 2042, mishandling bolt blocker 2044, a drive head 2046, two upper drive plates 2048-1 and 2048-2, an upper drive rack 2050, lower drive rack 2051, and a reverse action gear 2052. Upper connection bar 2042 is fixed by mishandling bolt blocker 2044 to drive head 2046. Drive head 2046 is fixed between the upper ends of upper drive plates 2048-1 and 2048-2, and upper drive rack 2050 is fixed between the lower ends of upper drive plates 2048-1 and 2048-2. Drive head 2046 may have a cup 2049 coupled to drive an upper rod. Similarly lower drive rack 2051 may have a cup 2053 coupled to drive a lower rod. Although illustrated as many elements, the reverse action assembly may be implemented with a less number of elements.

Reverse action assembly is placed in the case assembly with a vertical slot 2054 of upper connection bar 2042 receiving a pin 2056 of top screw post 2004, a pin 2057 of drive head 2046 inserted into a vertical slot 2058 of backset case 2002, a pin 2060 of upper drive rack 2050 inserted into a vertical slot 2062 of backset case 2002, and upper drive rack 2050 placed in a vertical channel formed by second gear shoe 2016. Two pinion gears 2063 are seated in second gear shoe 2016 to engage a lower front rack 2064 of upper drive rack 2050. Lower drive rack 2051 is placed in the case assembly with a rack portion over pinion gears 2063 in a vertical channel formed by second gear shoe 2016. Lower drive rack 2051 also has a pin 2084 (FIG. 21) inserted into a vertical slot 2086 of backset case 2002. As described, reverse action assembly is limited to a vertical travel. Reverse action gear 2052 is a dual gear with a small gear concentric with a large gear. Reverse action gear 2052 is inserted into a hole 2066 of backset case 2002 with its large gear engaging an upper side rack 2068 of upper drive rack 2050.

A handle assembly includes a spindle drive or drive hub 2070, a drive ring 2072, and a handle return spring 2074 to raise or lower upper drive rack 2050 and lower drive rack 2051. Spindle drive 2070 has a shaft 2076 (FIG. 21) with diametrically opposed keys inserted into a hole 2078 of backset case 2002. Hole 2078 has enlarged keyways that receive the keys of shaft 2076. Drive ring 2072 has a hole 2080 placed over a shaft 2082 of spindle drive 2070. Hole 2080 has enlarged keyways that receive diametrically opposed keys of shaft 2082. Handle return spring 2074 has one end fixed to a tab of spindle drive 2070 and another end fixed to spring pin 2019 mounted to backset case 2002. Handle return spring 2074 is spring-loaded to return spindle drive 2070 to its rest position where a connected lever would be level.

A backset cover 2088 is secured to the case assembly with screws 2090. Backset cover 2088 defines a vertical slot 2092 to receive a pin 2093 of drive head 2046, a vertical slot 2094 to receive a pin 2095 of first lock bar 2020, a hole 2096 to receive a shaft of tail drive 2024, a vertical slot 2098 to receive a pin 2099 of upper drive rack 2050, a hole 2100 to receive reverse action gear 2052, a hole 2102 with enlarged keyways to receive a shaft 2082 of spindle drive 2070, and a vertical slot 2104 to receive a pin 2105 of lower drive rack 2051.

Primed State

FIGS. 22 and 23-1 are front and back views of assembled passive panel center gearbox 1902 at the initial primed state with tail drive 2024 rotated away from the door edge and held so its tail slot is 45 degrees from an initial horizontal position, upper connection bar 2042 lowered, mishandling bolt blocker 2044 retracted, and lower drive rack 2051 raised in examples of the present disclosure. FIG. 23-2 shows the same view as FIG. 23-1 but with second case insert 2012 removed so the interaction between first lock bar 2020 and spindle drive 2070 can be seen. Second case insert 2012 has also been removed from later figures of passive panel center gearbox 1902.

In the prime state, first lock bar 2020 is in its lower position and second lock bar 2022 (FIG. 22) is in its upper position with upper rack 2036 blocked by the teeth of drive ring 2072 from returning to the at rest position that is spring-loaded by lock bar spring 2026. This allows the handle assembly to rotate to raise or lower upper drive rack 2050 and lower drive rack 2051.

Lever Up State

Figure 24:
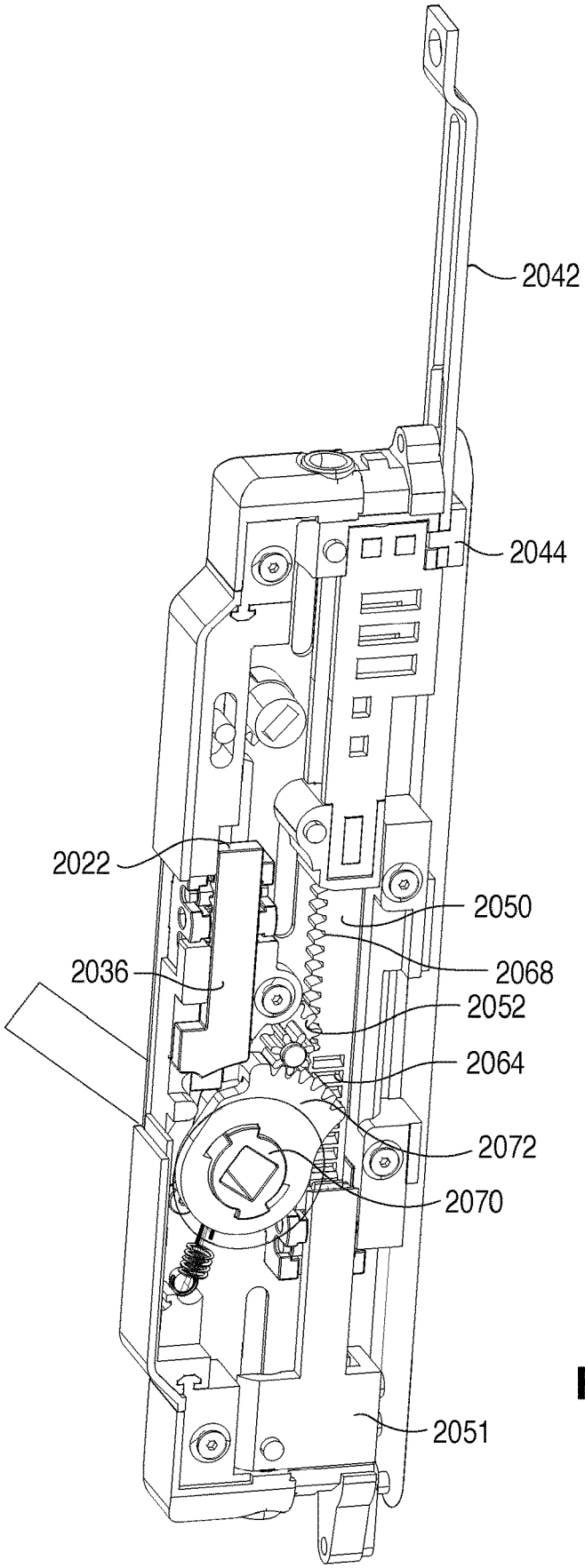
FIGS. 24 and 25 are front and back perspective views of the passive panel center gearbox of FIG. 19 at a "lever up" state in examples of the present disclosure.
Figure 25:
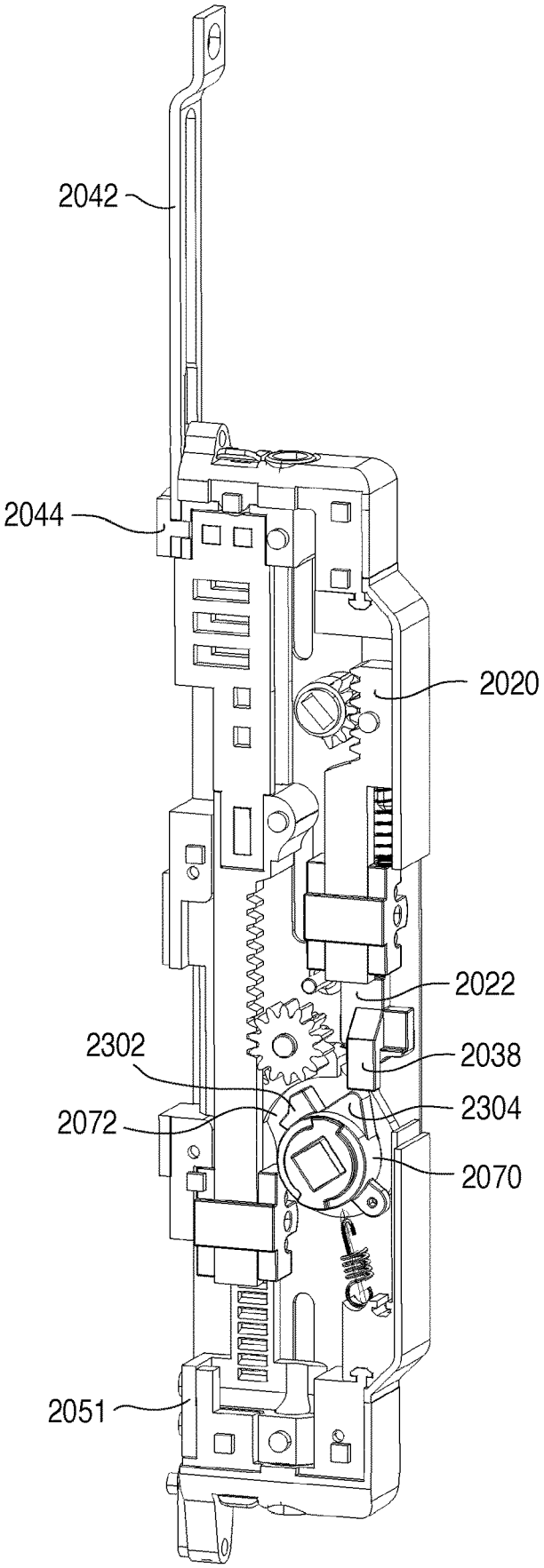

From the primed state with tail drive 2024 rotated and held, passive panel center gearbox 1902 may transition to a "lever up" state with a lever lifted up to rotate spindle drive 2070 by, e.g., 36 degrees. FIGS. 24 and 25 are front and back views of passive panel center gearbox 1902 in the lever up state in examples of the present disclosure. This may be the state of passive panel center gearbox 1902 when a passive panel fitted with the gearbox is closed and the lever is lifted up to extend upper connection bar 2042, mishandling bolt blocker 2044, and lower drive rack 2051. Lifting the lever up rotates spindle drive 2070, which in turn rotates drive ring 2072. Drive ring 2072 rotates the smaller gear of reverse action gear 2052, which has its large gear engaged with rack 2068 of upper drive rack 2050. The rotation of reverse action gear 2052 translates upper drive rack 2050 to its upper position. Upper drive rack 2050 has another rack 2064 coupled by pinion gears 2063 to lower drive rack 2051. The upward movement of upper drive rack 2050 causes lower drive rack 2051 to translate to its lower position.

As described in the primed state, upper rack 2036 of second lock bar 2022 is initially blocked by the teeth of drive ring 2072. As drive ring 2072 rotates, the bottom of upper rack 2036 eventually clears the gears of drive ring 2072 but upper rack 2036 is held up by lobe 2304 of spindle drive 2070 supporting lower leg 2038 of second lock bar 2022 as seen in FIG. 25.

When the lever is released, spindle drive 2070 returns to its at rest position made possible by the backlash provided through enlarged keyways in drive ring 2072 and handle return spring 2074.

Locked State

Figure 26:
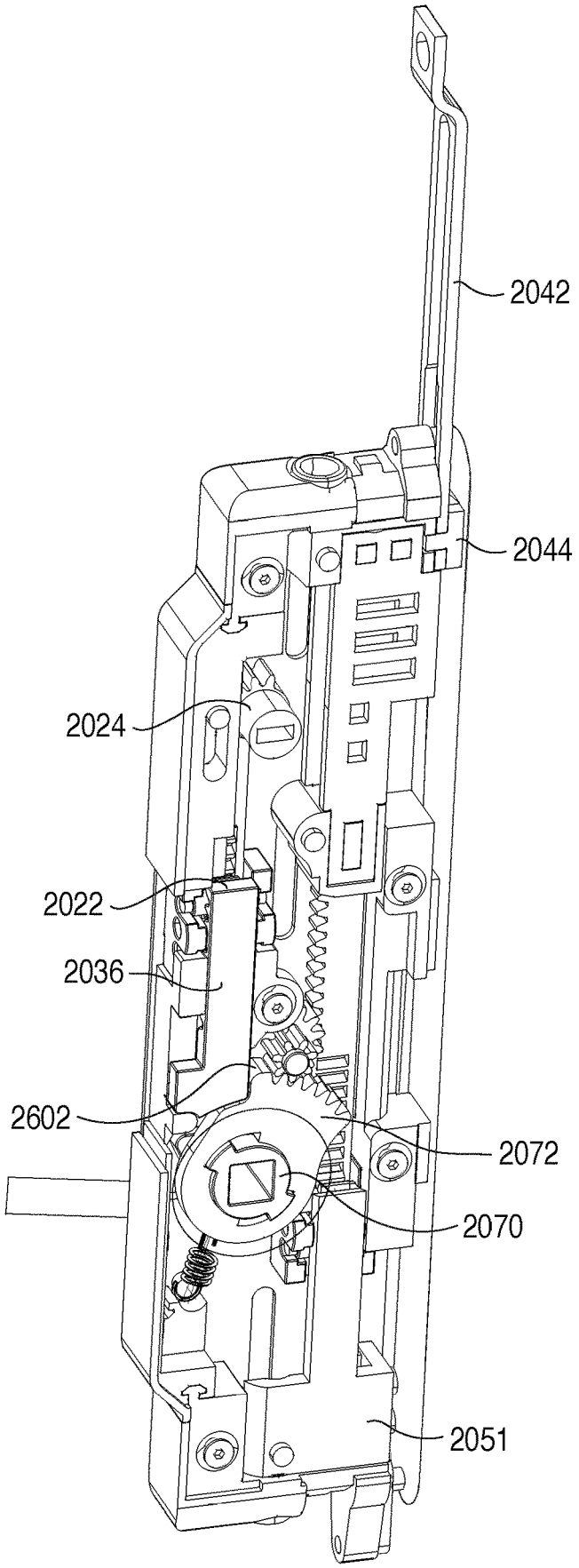
FIGS. 26 and 27 are front and back perspective views of the passive panel center gearbox of FIG. 19 at a "locked" state in examples of the present disclosure.
Figure 27:
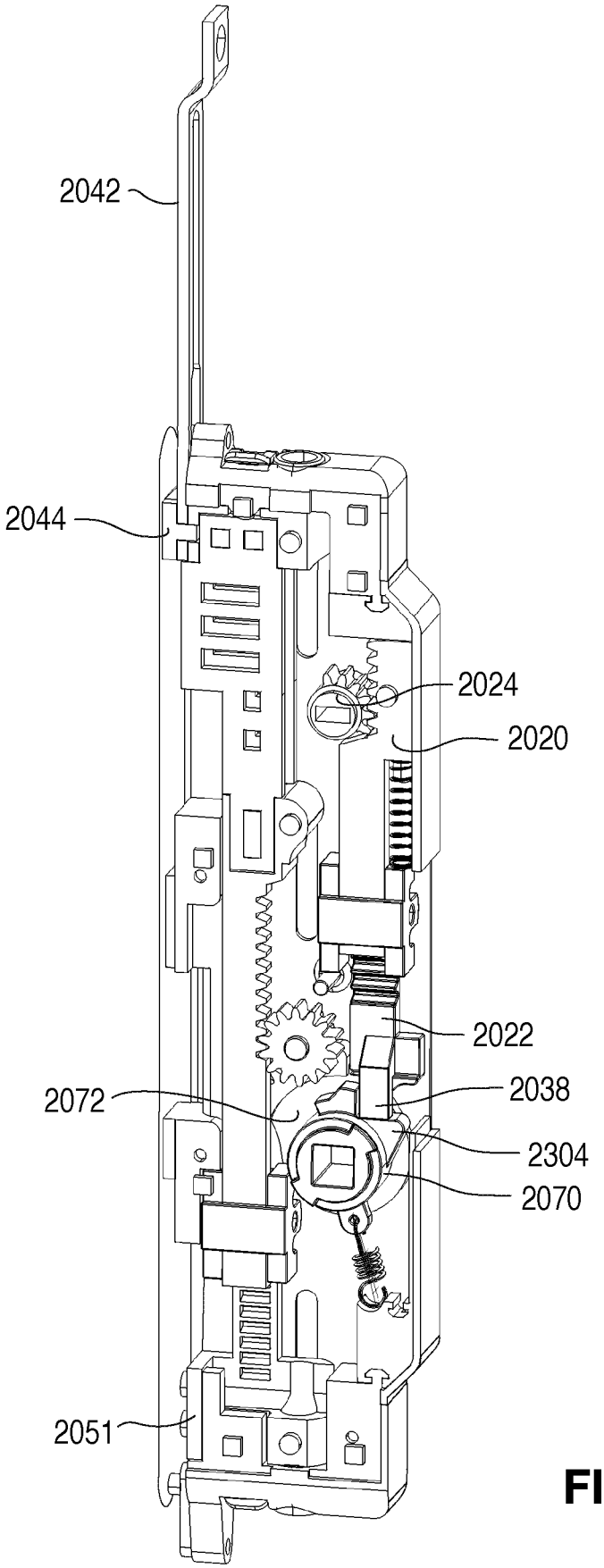

From the lever up state, passive panel center gearbox 1902 may transition to a "locked" state where tail drive 2024 and spindle drive 2070 returns to their at rest positions. FIGS. 26 and 27 are front and back views of passive panel center gearbox 1902 in the locked state in examples of the present disclosure. As the keys on spindle drive 2070 is smaller than the keyways in drive ring 2072, spindle drive 2070 can return to its at rest position without rotating spindle drive 2070 and retracting upper connection bar 2042, mishandling bolt blocker 2044, and lower drive rack 2051.

As spindle drive 2070 returns to its at rest position, lower leg 2038 of second lock bar 2022 eventually clears lobe 2304 of spindle drive 2070 and drops down in between lobes 2302 and 2304 to lock spindle drive 2070 as seen in FIG. 27. Referring back to FIG. 26, upper rack 2036 of second lock bar 2022 also drops down on one side of the teeth of drive ring 2072 to lock drive ring 2072. Thus both spindle drive 2070 and drive ring 2072 cannot be rotated to retract upper connection bar 2042, mishandling bolt blocker 2044, and lower drive rack 2051 without first turning a thumb turn to rotate tail drive 2024 to raise second lock bar 2022.

Note that mishandling bolt blocker 2044 is mobile and moves from a lower position to an upper position when the lever is pulled up. This feature prevents an active panel with an active panel center gearbox having a mishandling mechanism, such as active panel center gearbox 102 with mishandling bolt 212, to become locked against a passive panel with passive panel center gearbox 1902 when passive panel center gearbox 1902 is not locked. In other words, until passive panel center gearbox 1902 is in the lever up or locked state with mishandling bolt blocker 2044 in its upper position at the same height as mishandling bolt 212 of active panel center gearbox 102, active panel center gearbox 102 would have mishandling bolt 212 extended so active panel center gearbox 102 cannot be locked. Once passive panel center gearbox 1902 is in the lever up or locked state, mishandling bolt blocker 2044 would push back the mishandling bolt into the active panel center gearbox 102 and active panel center gearbox 102 can be locked. In addition, while mishandling bolt blocker 2044 is in its retracted lower position, it prevents a deadbolt from entering the deadbolt keep.

Lever Down State

Figure 28:
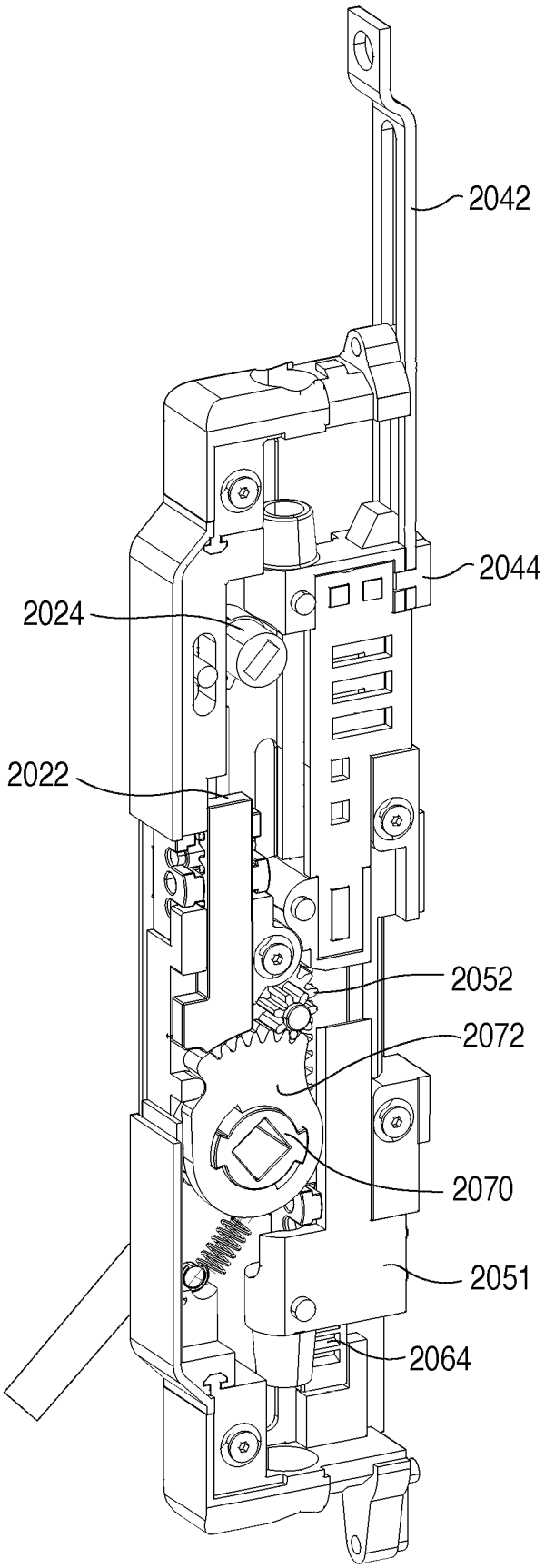
FIGS. 28 and 29 are front and back perspective views of the passive panel center gearbox of FIG. 19 at a "lever down" state in examples of the present disclosure.
Figure 29:
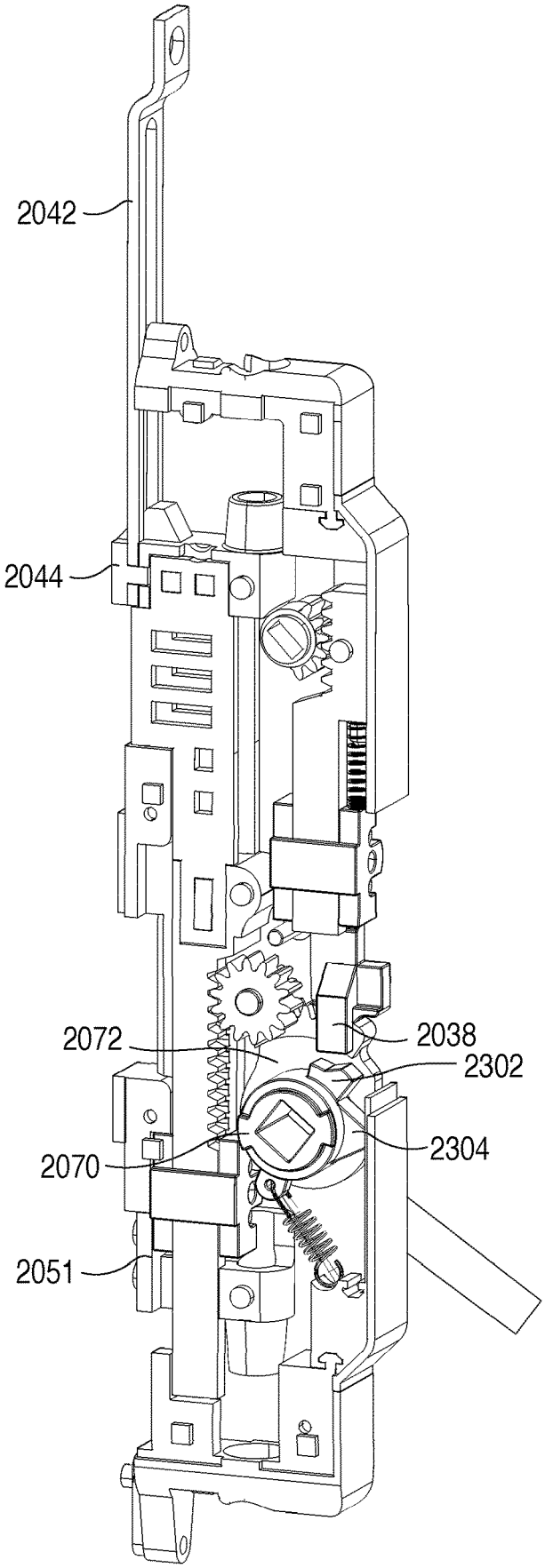

From the locked state, passive panel center gearbox 1902 may transition to a "lever down" state with tail drive 2024 rotated, e.g., 45 degrees, and held, and a lever pressed down to rotate spindle drive 2070 by, e.g., 36 degrees. FIGS. 28 and 29 are front and back views of passive panel center gearbox 1902 in the lever down state in examples of the present disclosure. This may be the state of passive panel center gearbox 1902 when a door fitted with the gearbox is closed and locked, and the lever is pressed down to retract upper connection bar 2042, mishandling bolt blocker 2044, and lower drive rack 2051. First, the thumb turn is rotated to rotate tail drive 2024 by, e.g., 36 degrees to raise second lock bar 2022 to its upper position. In this position, second lock bar 2022 does not engage lobes 2302, 2304 of spindle drive 2070 and the gears of drive ring 2072 so spindle drive 2070 and drive ring 2072 may rotate.

Next the lever is pressed down to rotate spindle drive 2070, which in turn rotates drive ring 2072. Drive ring 2072 rotates the small gear of reverse action gear 2052, which has its large gear engaged with rack 2068 of upper drive rack 2050. The rotation of reverse action gear 2052 translates upper drive rack 2050 downward to its lower position. Upper drive rack 2050 has another rack 2064 coupled by pinion gears 2063 to lower drive rack 2051. The downward movement of upper drive rack 2050 causes lower drive rack 2051 to rise to its upper position.

When the lever is released, spindle drive 2070 returns to its at rest position made possible by the free-play provided through enlarged keyways in drive ring 2072 and handle return spring 2074. At that point passive panel center gearbox 1902 returns to the prime state.

Astragal Bridge

Figure 30:
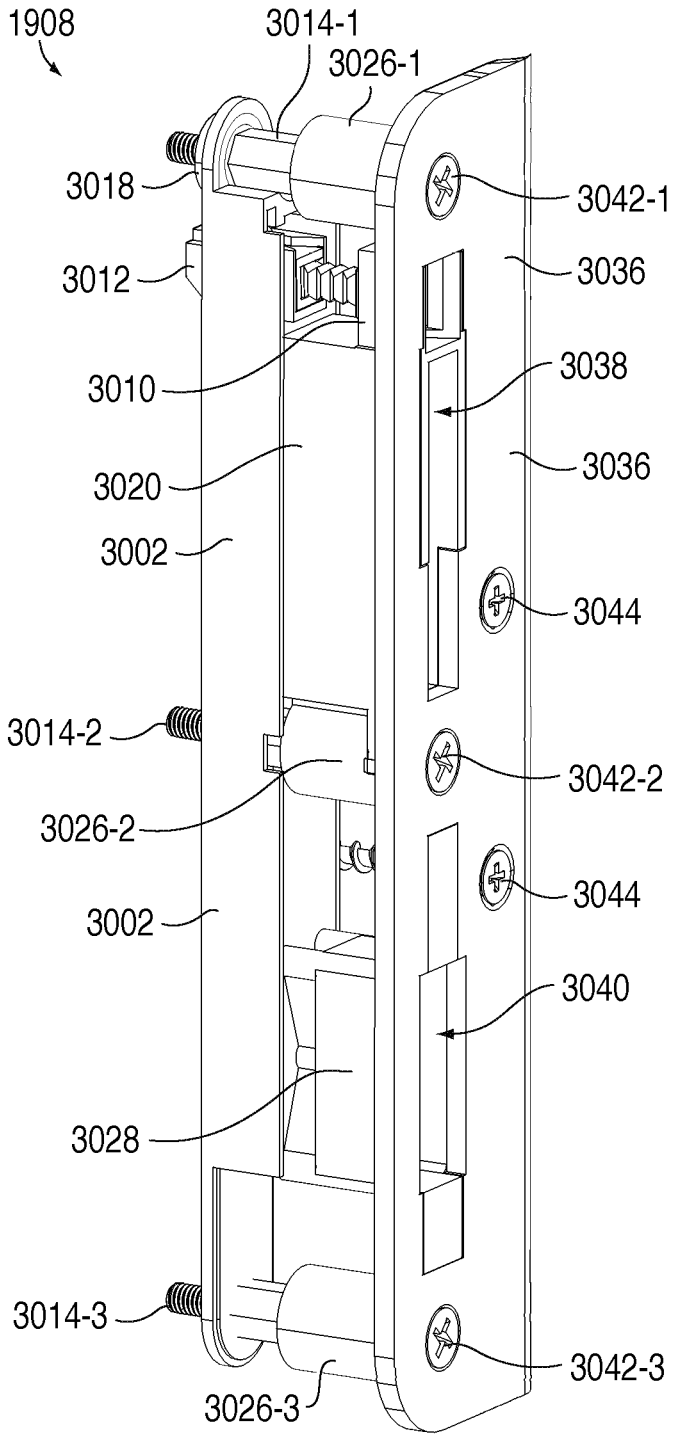
FIG. 30 is a perspective view of an astragal bridge of FIG. 19 in examples of the present disclosure.
Figure 31:
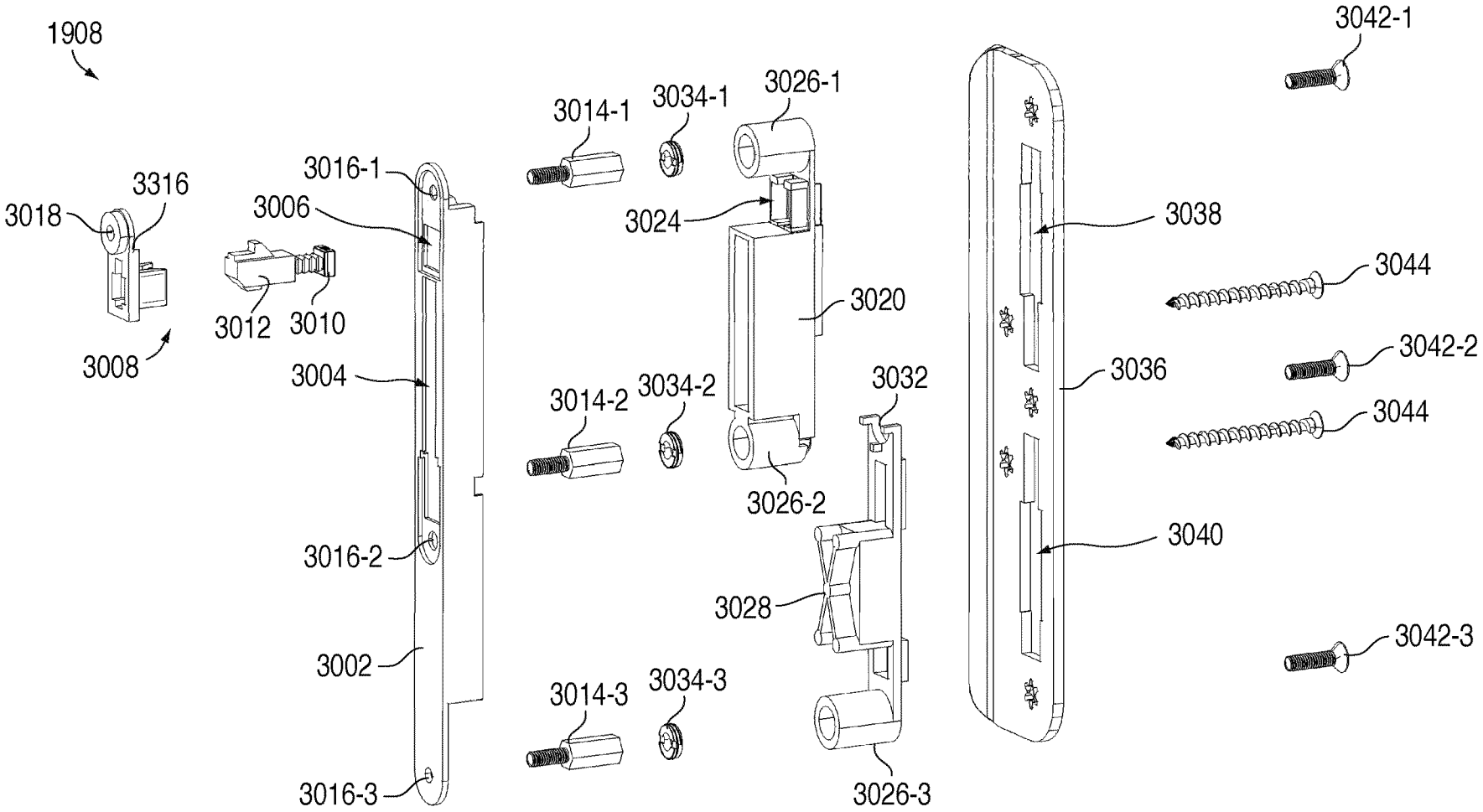
FIGS. 31 and 32 are exploded views of the astragal bridge of FIG. 30 from different angles in examples of the present disclosure.
Figure 32:
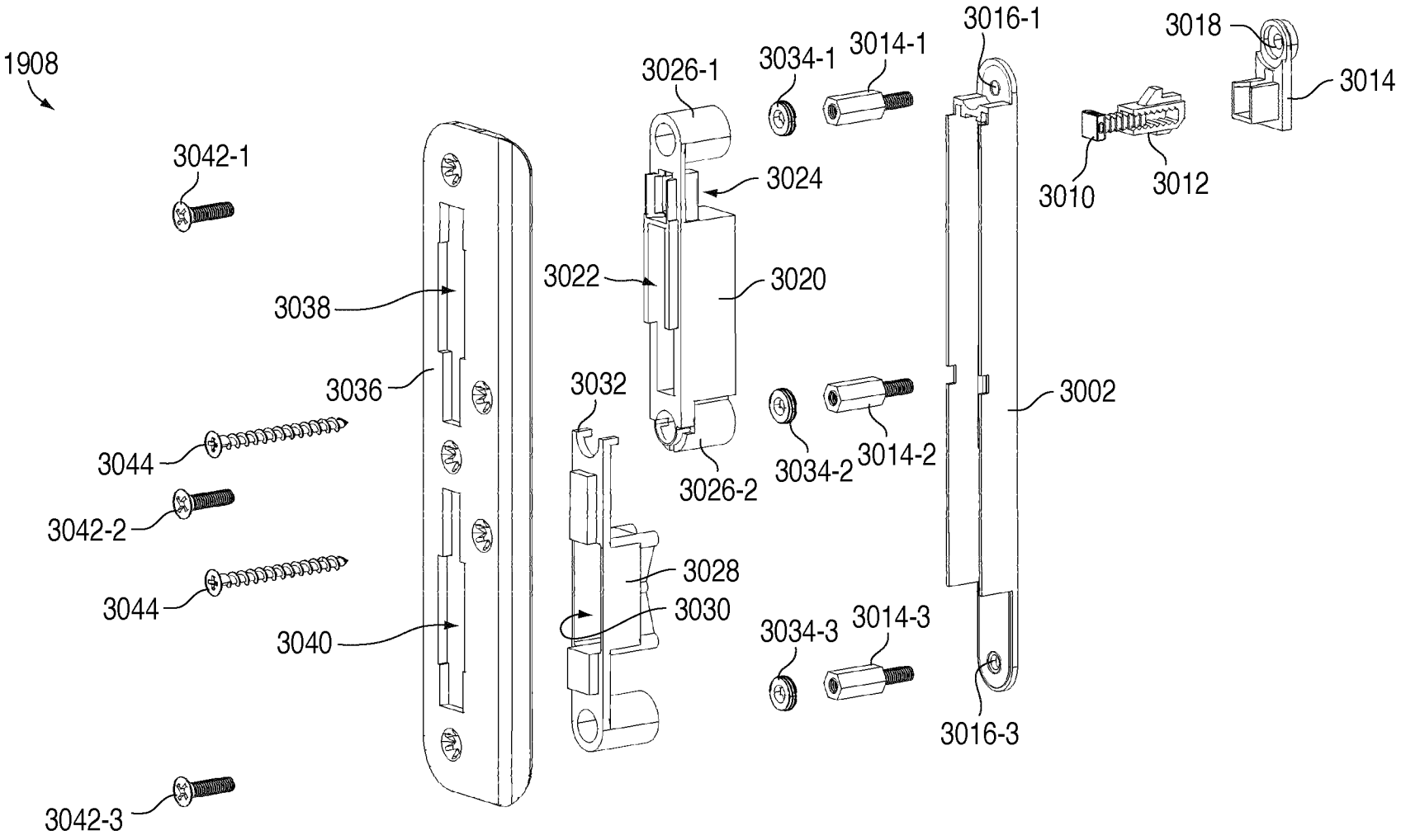

When a passive panel has an astragal, an astragal bridge 1908 may be fitted to passive panel center gearbox 1902 as shown in variations 1912 and 1913 in FIG. 19. Astragal bridge 1908 provides a mechanism to extend the mishandling bolt blocker 2044 (FIG. 22) of passive panel center gearbox 1902 through the astragal. FIG. 30 is a perspective view of an astragal bridge 1908, and FIGS. 31 and 32 are exploded views of astragal bridge 1908 from different angles in examples of the present disclosure.

Astragal bridge 1908 includes a center dust cap 3002 that defines a vertical slot 3004 (FIG. 31) for receiving mishandling bolt blocker 2044 (FIG. 22) from center gearbox 1902 (FIG. 22). Center dust cap 3002 also defines an opening 3006 (FIG. 31) for receiving a mishandling bolt blocker extender 3008.

Mishandling bolt blocker extender 3008 includes a toothed bolt 3010, a toothed shuttle 3012 that receives toothed bolt 3010 at a desired depth according to the thickness of the astragal, and a housing 3316 that receives toothed shuttle 3012 with toothed bolt 3010. Toothed bolt 3010 has two pairs of racks (four tooth racks total), each pair is symmetrical with the same tooth profile and the two pairs are offset by 1 mm.

A hex screw post 3014-1 is inserted through an opening 3016-1 in center dust cap 3324 and an opening 3018 in housing 3316 and fastened to passive panel center gearbox 1902 (not shown). Hex screw posts 3014-2 and 3014-3 are inserted through screw openings 3016-2 and 3016-3 in center dust cap 3002 and fastened to passive panel center gearbox 1902.

A deadbolt dust cap 3020 defines an opening 3024 for toothed bolt 3010 of mishandling bolt blocker extender 3008. Deadbolt dust cap 3020 has an upper threaded socket 3026-1 and a lower threaded socket 3026-2. A latch dust cap 3028 defines an upper cup 3032 with features that interlocks with threaded socket 3026-2 of deadbolt dust cap 3020, and a threaded socket 3306-3. Although illustrated as many elements, dust caps 3002, 3020, and 3028 may be integrated as a single element or a less number of elements.

Adjustment washers 3034-1, 3034-2, and 3034-3 are threaded in threaded sockets 3026-1, 3026-2, and 3026-3 to a desired depth according to the thickness of the astragal. Hex nut screws 3014-1, 3014-2, and 3014-3 are seated in threaded sockets 3026-1, 3026-2, and 3026-3 to locate dust caps 3020 and 3028 over dust cap 3002.

A striker 3036 defines a keep 3038 for both a mishandling bolt and a deadbolt, and a keep 3040 for a latch bolt. Screws 3042-1, 3042-2, 3042-3 are inserted through striker 3036 and fastened to hex screw posts 3014-1, 3014-2, and 3014-3 to secure striker 3036 to dust caps 3020, 3028, 3002 and passive panel center gearbox 1902 (FIG. 22). Additional screws 3044 may be inserted through striker 3036 to secure striker 3036 to the passive panel.

In operation, mishandling bolt blocker 2044 (FIG. 22) from passive panel center gearbox 1902 (FIG. 22) may move vertically up through slot 3004 in center dust cap 3002. Near the top, a ramp on the top of mishandling bolt blocker 2044 pushes up against an opposing ramp formed on toothed shuttle 3012, which causes tooth shuttle 3012 with toothed bolt 3010 to translate horizontally through opening 3024 in deadbolt dust cap 3020 and into keep 3038 of striker 3036 where toothed bolt 3010 can push against mishandling bolt 212 (FIG. 4) from active panel center gearbox 102 (FIG. 4). Note that the sizes of various components may be adjusted for thin and thick astragals.

Figure 33:
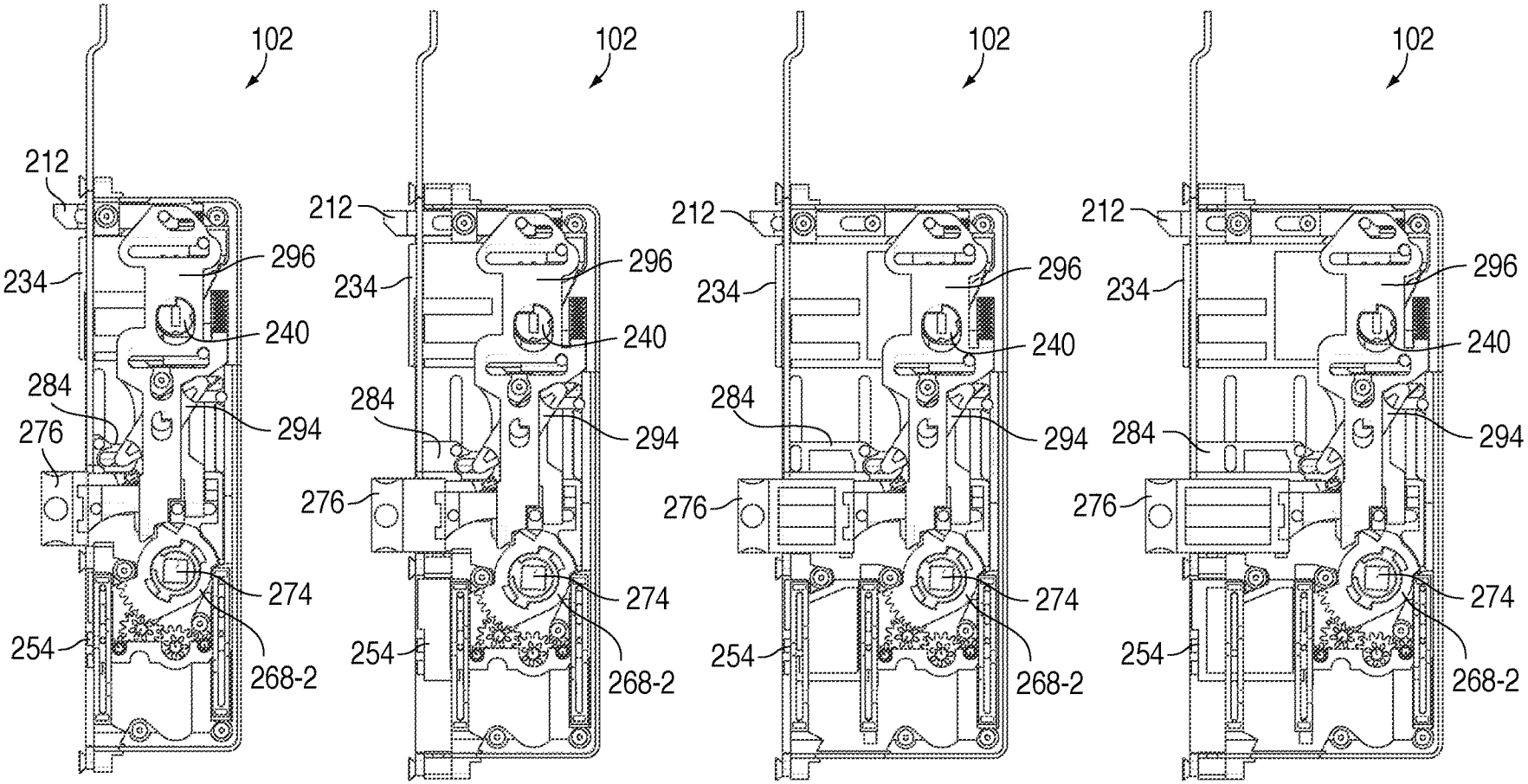
FIG. 33 illustrates various active panel center gearboxes with different backsets in examples of the present disclosure.

FIG. 33 illustrates various active panel center gearboxes with different backsets in examples of the present disclosure. As can be seen, mishandling bolt 212, deadbolt 234, the latch head 276, front lower drive bar 254, and upper drive bar cup 284 have depths that correspond to the backset of an active panel center gearbox 102 so horizontal dimensions of deadbolt drive 240, the handle assembly (spindle drive 274, drive ring 268-1 (not visible), and drive ring 268-2), reverse action rocker 294, mishandling plate 296, and block plate 222 (not visible) remain constant for active panel center gearboxes 102 of different backsets.

Various other adaptations and combinations of features of the embodiments disclosed are within the scope of the invention. Numerous embodiments are encompassed by the following claims.

The invention claimed is:

1. A lock system comprising an active panel center gearbox and a passive panel center gearbox:

the active panel center gearbox comprising:

a deadbolt having a pin;

a deadbolt drive being rotatable to extend or retract the deadbolt;

a vertically translatable upper drive assembly;

a vertically translatable lower drive assembly;

a latch bolt;

a handle assembly being rotatable to retract the latch bolt and to extend or retract the lower and the upper drive assemblies;

a reverse action rocker having a shaft, the reverse action rocker coupling the lower drive assembly to the upper drive assembly so they translate in different directions;

a mishandling bolt having a pin;

a vertically translatable mishandling plate, defining:

a first slot receiving the pin of the mishandling bolt, the first slot comprising an inclined portion and a horizontal portion;

a second slot receiving the pin of the deadbolt, the second slot comprising a vertical portion and a horizontal portion;

a vertical guide receiving the shaft of the reverse action rocker; and a tab;

wherein, when the mishandling bolt is extended from the active panel center gearbox and the mishandling plate is lowered:

the pin of the mishandling bolt is in the inclined portion of the first slot of the mishandling plate;

the vertical portion of the second slot of the mishandling plate engages the pin of the deadbolt to prevent the deadbolt from extending;

the tab of the mishandling plate engages the handle assembly to prevent the handle assembly from rotating to lower the lower drive assembly; and the vertical guide of the mishandling plate engages the shaft of the reverse action rocker to prevent the reverse action rocker from rotating to raise the upper drive assembly;

the passive panel center gearbox being installed at a same height as the active panel center gear box, the passive panel center gearbox comprising:

a vertically translatable upper drive rack;

a vertically translatable lower drive rack;

a pinion gear between the upper and the lower drive racks to translate the upper and the lower drive racks in different directions;

a passive panel handle assembly rotatable to lower or raise the upper and the lower drive racks; and a drive head coupled to the upper drive rack, the drive head comprises a mishandling bolt blocker; and wherein, when passive panel handle assembly rotates in one direction:

the upper drive rack rises so the mishandling bolt blocker is raised to a same height as the mishandling bolt of the active panel center gearbox to prevent the mishandling bolt from extending when panels having the active and the passive panel center gearboxes are closed; and the lower drive rack lowers.

2. The lock system of claim 1, wherein:

the passive panel center gearbox further comprises:

a vertically translatable lock bar; and a tail drive rotatable to raise the lock bar; and when the tail drive is rotated from a resting position and held, the lock bar rises to release the handle assembly to allow the passive panel handle assembly to rotate in the one direction to raise the upper drive rack and lower the lower drive rack.

3. The system of claim 2, wherein when the tail drive returns to the resting position after the passive panel handle assembly is rotated in the one direction, the lock bar lowers to engage the passive panel handle assembly so the passive panel handle assembly cannot rotate in another direction to lower the upper drive rack and raise the lower drive rack.

4. The system of claim 2, wherein:

the passive panel center gearbox further comprises a reverse action gear engaging the upper drive rack;

the passive panel handle assembly comprises:

a spindle drive having:

a shaft having a key; and lobes on the shaft of the spindle drive;

a drive ring fitted on the shaft of the spindle drive, the drive ring having:

a keyway to receive the key on the shaft of the drive ring; and teeth engaging the reverse action gear to raise and lower the upper drive rack; and when the lock bar is lowered, the lock bar engages the lobes and the teeth to prevent the passive panel handle assembly from rotating.

5. The system of claim 2, wherein:

the center gearbox further comprises:

another vertically translatable lock bar; and another pinion gear between the lock bar and the other lock bar to translate the lock bar and the other lock bar in different directions; and the tail drive engages the other lock bar to lower or raise the other lock bar and the lock bar in different directions.

6. The system of claim 3, wherein, when the tail drive is rotated from the resting position and held, the lock bar rises to release the passive panel handle assembly to allow the passive panel handle assembly to rotate in the other direction to lower the upper drive rack lowers and raise the lower drive rack.

7. The system of claim 1, wherein the passive panel center gearbox further comprises:

upper drive plates connected to the upper drive rack, the upper drive plates defining a space to receive a deadbolt, wherein the drive head is connected to the upper drive plates; and an upper connector bar connected to the drive head.

8. The system of claim 7, further comprising:

an upper or mid extension coupled to the upper connector bar; and a lower extension coupled to the lower drive rack, wherein the other lower extension and the other upper extension comprise shooting bolt mechanisms or strikers.

9. The system of claim 7, further comprising:

an upper or mid rod coupled to the drive head;

a lower rod coupled to the lower drive rack; and shooting bolt mechanisms coupled to the lower and the upper rods.

10. The system of claim 1, further comprising:

an astragal bridge, comprising:

a mishandling bolt blocker extender; and a center dust cap defining:

an opening receiving the mishandling bolt blocker extender; and a slot below the opening, the slot receiving the mishandling bolt blocker of the passive panel center gearbox;

wherein, when the mishandling bolt blocker travels up the slot of the center dust cap, the mishandling bolt blocker pushes against the mishandling bolt blocker extender to extend the mishandling bolt blocker extender to depress the mishandling bolt into the active panel center gearbox.

11. The system of claim 10, wherein the mishandling bolt blocker extender comprises:

a toothed bolt; and a toothed shuttle receiving the toothed bolt, the toothed shuttle comprising a bottom ramp to engage a top ramp on the mishandling bolt blocker of the passive panel center gearbox when the mishandling bolt blocker travels up through the slot of the center dust cap.

12. The system of claim 10, wherein the astragal bridge further comprises:

a striker defining openings to pass a mishandling bolt, a deadbolt, and a latch bolt;

a deadbolt dust cap mounted to the striker;

a latch bolt dust cap mounted to the striker; and the center dust cap is mounted to the deadbolt and the latch bolt dust caps.

13. The system of claim 12, wherein:

the deadbolt and the latch bolt dust caps comprise threaded sockets;

the astragal bridge further comprises:

adjustment washers threaded in the threaded sockets;

screw posts to secure the center dust cap to the passive panel center gearbox, wherein heads of the screw posts are seated in the threaded sockets; and screws to secure the striker through the threaded sockets to the screw posts.

* * * * *